United States Patent [19]

Negoro et al.

[11] Patent Number: 5,023,667

[45] Date of Patent: Jun. 11, 1991

[54] APPARATUS FOR PREVENTING DAMAGE TO BOTH AN ELECTROPHOTOGRAPHIC PRINTER AND A RECORDING FORM USED WITH THE PRINTER

[75] Inventors: Ikuo Negoro, Sakado; Masatoshi Takano, Akikawa; Atsushi Chikama, Tokyo; Kiyoshi Negishi, Saitama, all of Japan

[73] Assignee: Asahi Kogaku Kogyo Kabushiki Kaisha, Tokyo, Japan

[21] Appl. No.: 372,537

[22] Filed: Jun. 28, 1989

[30] Foreign Application Priority Data

| | | | |
|---|---|---|---|
| Jun. 28, 1988 | [JP] | Japan | 63-160328 |
| Jul. 1, 1988 | [JP] | Japan | 63-177466 |
| Jan. 10, 1989 | [JP] | Japan | 1-1522 |
| Apr. 13, 1989 | [JP] | Japan | 1-94071 |
| Jun. 16, 1989 | [JP] | Japan | 1-153746 |

[51] Int. Cl.[5] ..... G03G 15/16; G03G 15/20

[52] U.S. Cl. ..... 355/274; 355/271; 355/290; 355/282; 355/308

[58] Field of Search ..... 355/274, 271, 295, 290, 355/215, 282, 310, 200, 308; 346/160.1

[56] References Cited

U.S. PATENT DOCUMENTS

| | | | |
|---|---|---|---|
| 4,110,027 | 8/1978 | Sato et al. | 355/274 |
| 4,260,242 | 4/1981 | Nishikawa | 355/210 |
| 4,265,198 | 5/1981 | Shinohara et al. | 118/695 |
| 4,306,800 | 12/1981 | Kopp | 355/271 |
| 4,370,050 | 1/1983 | Matsui et al. | 355/309 X |
| 4,377,333 | 3/1983 | Tsuji et al. | 355/309 |
| 4,421,401 | 12/1983 | Kagiura et al. | 355/295 X |
| 4,429,984 | 2/1984 | Kiba et al. | 355/215 X |
| 4,431,180 | 2/1984 | Nakajima | 271/274 |
| 4,478,508 | 10/1984 | Kato et al. | 355/282 X |
| 4,547,062 | 10/1985 | Fujiwara | 355/309 |
| 4,609,279 | 9/1986 | Hausmann et al. | 355/308 |
| 4,668,072 | 5/1987 | Yasuda | 355/200 X |
| 4,699,496 | 10/1987 | John et al. | 355/277 |
| 4,750,018 | 6/1988 | Gooray et al. | 355/303 |
| 4,963,941 | 10/1990 | Negishi et al. | 355/282 |

OTHER PUBLICATIONS

English Abstracts of Japanese patent Nos. 57-124774 and 57-93375.

Research Disclosure No. 250, Feb. 1985, pp. 114-115, Abstract No. 25029, Emsworth, Hampshire, GB entitled "Flexible Sheet Cleaning Apparatus and Method".

Japanese Publication No. 61-226766-First Page of the Publication Along With English Language Abstract.

Japanese Publication No. 53-146637-First Page of the Publication Along With English Language Abstract.

Japanese Publication No. 55-17102-First Page of the Publication and Abstract.

*Primary Examiner*—A. T. Grimley

*Assistant Examiner*—J. E. Barlow, Jr.

*Attorney, Agent, or Firm*—Sandler, Greenblum & Bernstein

[57] ABSTRACT

A printer for electrophotographically forming an image on a continuous-form recording paper. The printer has a transfer unit and a pair of heat fixing rollers which are brought into a withdrawn state, in a print stand-by state. Thus, the recording paper is out of contact with a photoconductive drum and a heat roll when the transfer unit and heat fixing rollers are in their withdrawn state. A pair of dust removing brushs are also brought into a withdrawn state in the print stand-by state so as to be out of contact with the recording paper.

20 Claims, 24 Drawing Sheets

APPARATUS FOR PREVENTING DAMAGE TO BOTH AN ELECTROPHOTOGRAPHIC PRINTER AND A RECORDING FORM USED WITH THE PRINTER

BACKGROUND OF THE INVENTION

The present invention relates to a printer for electro photographically forming an image on a continuous-form recording paper.

There are known imaging devices using an electrophotographing process wherein the surface of a photo conductive drum is exposed to an optical image to form a latent image thereon. A toner is applied for development of the image on the drum. The toner image is then transferred to a recording paper and is fixed by means of a fixing device. One of such imaging devices is the printer which is adapted to print information on a continuous-form recording paper as used in conventional line printers.

The continuous-form recording paper is so-called fan-fold paper with sprocket holes (referred to simply as "continuous form" in later description). There are perforations at certain intervals of the paper to facilitate cutting the paper into separate sheets.

Different processes have been available to fix the toner image to the recording paper (continuous form) in such an electrophotographing process, examples of fixing processes are: thermally fusing the toner to the paper, using a solvent or applying a pressure. Thermal fusing process is widely used as it is considered to be the safest and most reliable way of fixing. Among several different types of such thermal fusing processes, most used is a heat roll system in which the recording paper with an image remaining unset is pressed against a heat roller so that the heat transferred from the heat roller fuses and sets the toner image.

The heat roll system uses a fixing roller pair consisting of the heat roller heated to a high temperature and a backup roller, the two rollers being placed in opposition to each other. The recording paper carrying an unfixed image is clamped between the two rollers so that it is pressed against the heat roller with a certain pressure to fix the toner image on the paper with the heat from the heat roller. The usual arrangement is such that the recording paper is traveled forward with rotation of the fixing roller pair itself.

The electrophotographic printer using continuous form usually employs the heat roll system.

In printers using continuous form, however, printing has to start with a certain space from the perforation of the continuous form (i.e., top end of the page). On the other hand, the electrophotographic printing system is so configured that operating elements such as exposure, developer and transfer units are all placed along the circumference of a photoconductive drum. As a result, those individual units are brought into operation as the drum rotates so that the exposure and transfer processes take place in different positions. In order to make the exposure start position coincident with a certain point from the perforation of the continuous form with the start of printing (i.e., to start printing at a certain space from the perforation), it is necessary to adjust the print start position by moving the photoconductive drum relative to the continuous form before starting printing (start positioning). If the drum is kept in contact with the continuous form (held in a transfer operative position), the photoconductive material coated on the drum may be damaged or worn so as to shorten the life of the drum. This may also cause the continuous form to be soiled with toner remaining on the drum surface.

Another problem encountered is that when using the heat roll system as mentioned above, the heat roll must be constantly kept heated even in a print stand-by state, because heating the heat roller takes a considerable time. As a result, the recording paper (continuous form) constantly pressed between the heat roller and the backup roller is at its a certain section steadily exposed to the heat transferred from the heat roller, resulting in the paper being burnt or blistered.

The assignee of the present application has proposed an arrangement in which one of the fixing roller pair can be withdrawn from the other to avoid contact of the paper with the heat roller in the printing stand-by state and in which the transfer charger can be withdrawn from its transfer operating position to separate the recording paper from the drum. However, fabrication costs become high as separatre driving means have been employed for withdrawing the fixing roller and the transfer charger.

Further, the surface of the continuous form has paper dust particles deposited thereon which are developed during formation of sprocket holes and perforations. Such dust particles are likely to enter the transfer charger or be stuck onto the drum surface, resulting in various problems. To eliminate these problems, a cylindrical dust brush unit is provided near a paper inlet portion of the printer. The dust brush, in contact with the continuous form, is rotated in the direction opposite to the paper feed direction for brushing dust particles off the surface of the paper.

However, when the transfer charger and one of the fixing roller pair are withdrawn from their transfer operative and fixing operative positions during the print stand-by state, the continuous form can no longer retained at the position. As a result, the continuous form moves in opposite direction by the force exerted by brushing with the dust brush so that the print start position is deviated from the position.

Moreover, there has been a problem that the sensitized paper is attracted to the drum surface and can not be separated therefrom merely by withdrawing the transfer charger from its transfer operative position. Thus, an arrangement has been proposed such that a paper holder is provided on a pivotal member carrying the transfer charger so that the continuous form is passed between the paper holder and the transfer charger, whereby the continuous form is separated from the drum surface by means of this paper holder upon withdrawal movement of the transfer charger. With this arrangement, however, there has been a difficulty in loading the continuous form because the form has to be passed between the paper holder and the transfer charger.

SUMMARY OF THE INVENTION

It is therefore an object to of the invention to provide a printer using the continuous form in which the continuous form can be withdrawn from the drum at the transfer unit and from the heat roller at the fixing unit in a print stand-by state. The aforesaid object thereby prevents wear of the photoconductive drum as well as problems caused by heat applied to the continuous form. The withdrawing operation can be accomplished by a single-unit driving means.

According to the invention, there is provided a printer for electrophotographically forming an image on a continuous-form recording paper, which comprises:

a pair of fixing rollers, at least one of which is withdrawable from its fixing operative position;

a transfer charger withdrawable from its transfer operative position; and a drive means for executing withdrawing and restoring movements of said withdrawable roller of said fixing roller pair and of said transfer charger.

Also, it is so configured that it comprises transfer charger load means for loading said transfer charger to its transfer operative position, transfer charger lock means for fixedly locking said transfer charger in its withdrawn position and lock release means for releasing said transfer charger lock means, whereby said transfer charger is fixedly locked by said transfer charger lock means in its withdrawn position, and said transfer charger is restored to its transfer operative position by releasing said lock of said transfer charger by means of said lock release means.

The printer is structured so that said transfer charger is carried by a pivotally rockable arm member to allow said transfer charger to move from its transfer operative position to its withdrawn position by pivotal movement of said arm member, said arm member having a pressure guide rockably mounted on the pivotal center thereof for pivotal movement relative to said arm member, said pressure guide flexing a paper feed path toward a phoroconductive drum after the transfer unit, said arm member carrying said transfer charger being adapted to be pivotally driven for its withdrawing movement within a certain range of the pivotal movement of said pressure guide, and said printer further comprises a drive means for executing pivotal movements of said withdrawable roller of the fixing roller pair and of said pressure guide.

The printer is structured so that it comprises pressure guide loading means for biasing said pressure guide to a predetermined position, transfer charger loading means for biasing said transfer charger to its transfer operative position thereof, pressure guide lock means for fixedly locking said pressure guide in its withdrawn position, and lock release means for releasing said pressure guide lock means, wherein said transfer charger is fixed in its the withdrawn position by fixedly locking said pressure guide in its withdrawn position, and wherein said pressure guide is restored to its predetermined position, while said transfer charger is restored to its transfer operative position, by releasing said pressure guide lock means from locking by means of said lock release means.

Another object of the invention is to provide a printer using the continuous form, when withdrawn from the transfer operative and fixing operative positions in the print standby state, the continuous form is not changed from its specified position, enabling printing to start at the correct start position.

For the above purpose, according to the invention, there is provided a printer for electrophotographically forming an image on a continuous-form recording paper, which comprises;

a dust brush means provided adjacent the inlet of the continuous-form recording paper, said dust brush means being withdrawable from its position contacting the continuous-form recording paper;

a fixing roller means withdrawable from its fixing operative position;

a transfer means withdrawable from its transfer operative position; and a drive means for withdrawing and restoring said withdrawable fixing roller means, transfer means and dust brush means at predetermined timings.

Another object of the invention is to provide a printer using the continuous form, in which the continuous form can be separated from the drum surface with a rocking movement of the transfer unit for easier insertion of the continuous form during loading.

For the above purpose, according to the invention, there is provided a printer for electrophotographically forming an image on a continuous-form recording paper comprising a pivotally withdrawable transfer charger and a paper holder for holding the recording paper for said transfer charger, said transfer charger and said paper holder being pivotally swung to separate said recording paper from a photoconductive drum in a print stand-by state, said paper holder being pivotally movable relative to said transfer charger and provided with an operating member for effecting pivotal movement of said paper holder independently of said transfer charger.

The printer further comprises a push-up mechanism for loading the photoconductive drum located above the transfer charger in upward direction, and an operating member operatively associated with said push-up mechanism and said paper holder for rocking said paper holder upon push-up movement of the photoconductive drum by means of said push-up mechanism.

The drum located above the transfer charger is pressed against a lower structural part of the printer to lock it in a predetermined position upon closure of an upper structural part of the printer which is adapted to be pivotally moved relative to the lower structural part.

DESCRIPTION OF THE ACCOMPANYING DRAWINGS

Figure 6:
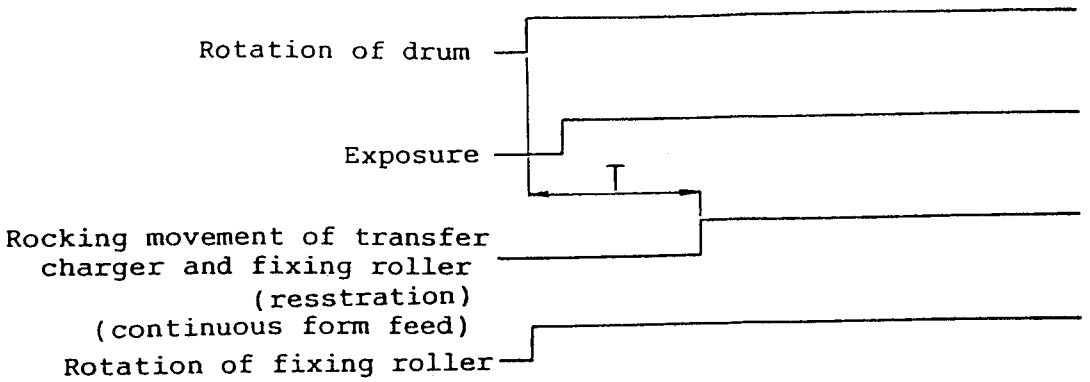
FIGS. 6 and 7 are operational time charts of the printer.
Figure 10A:
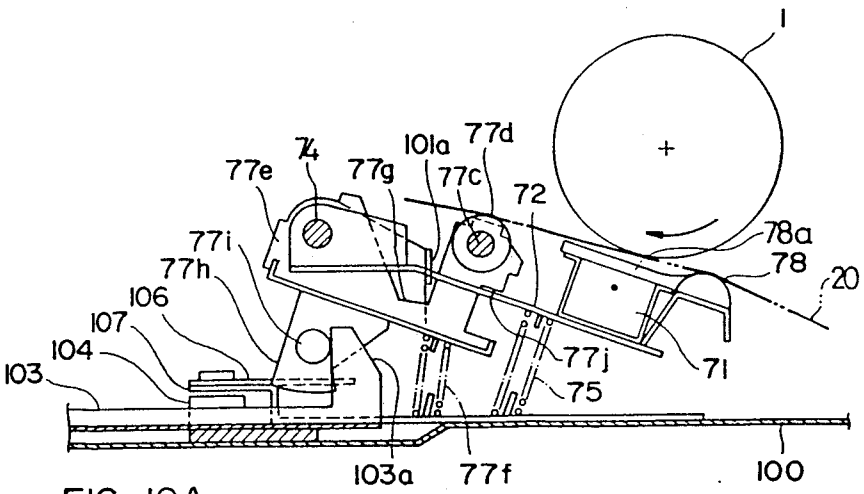
Figure 10B:
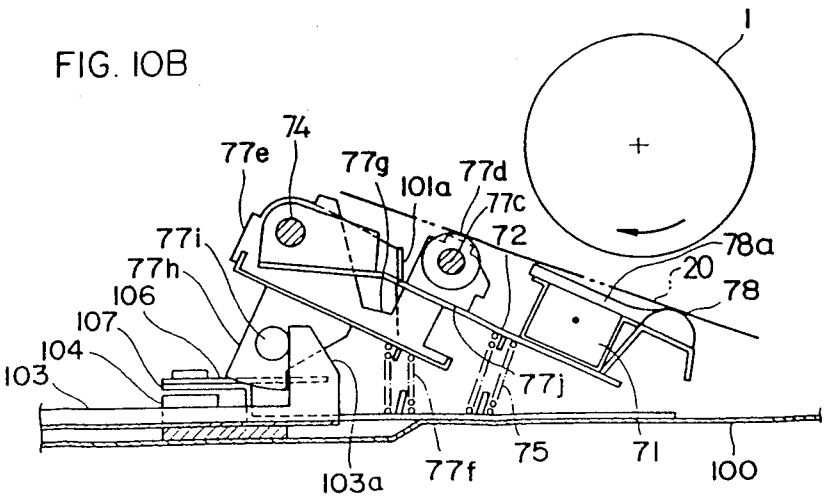
Figure 11:
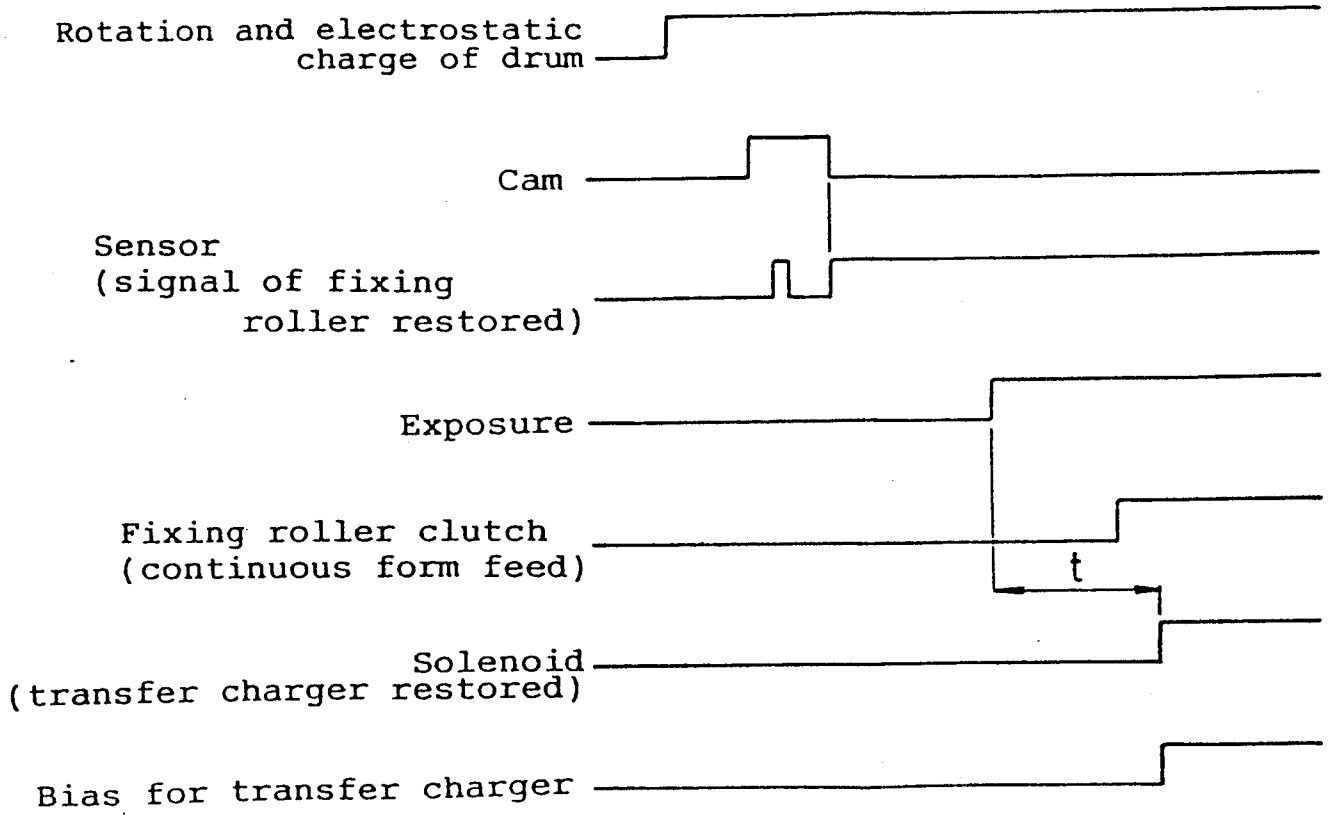
Figure 12:
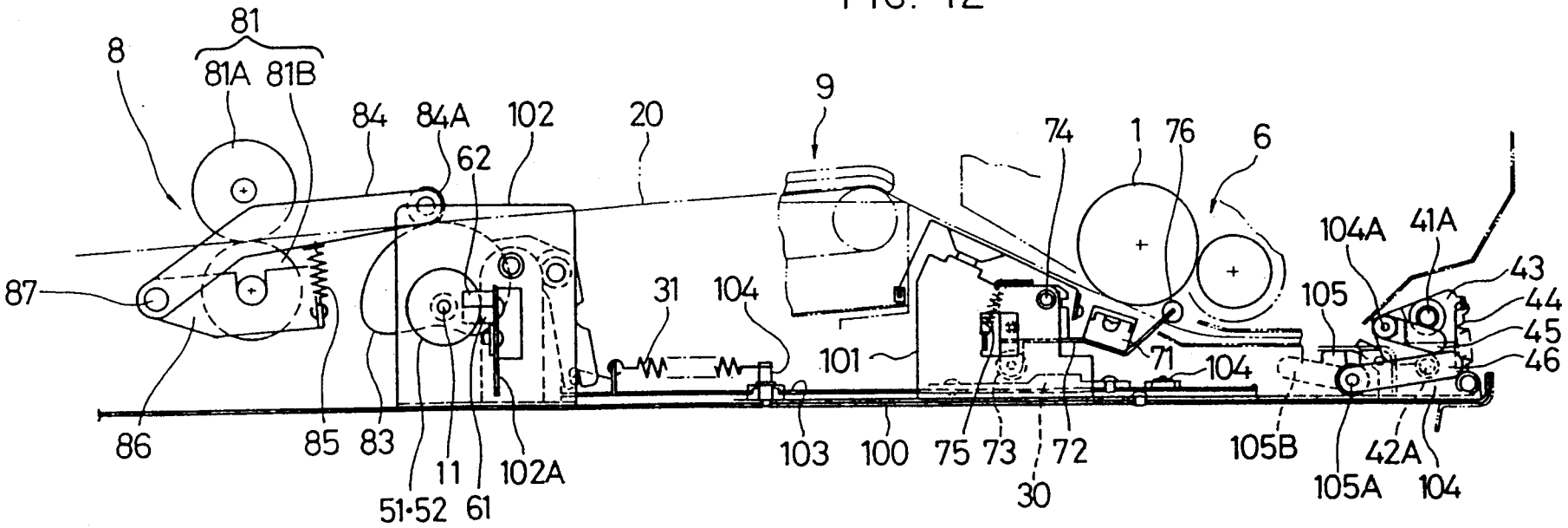
Figure 13:
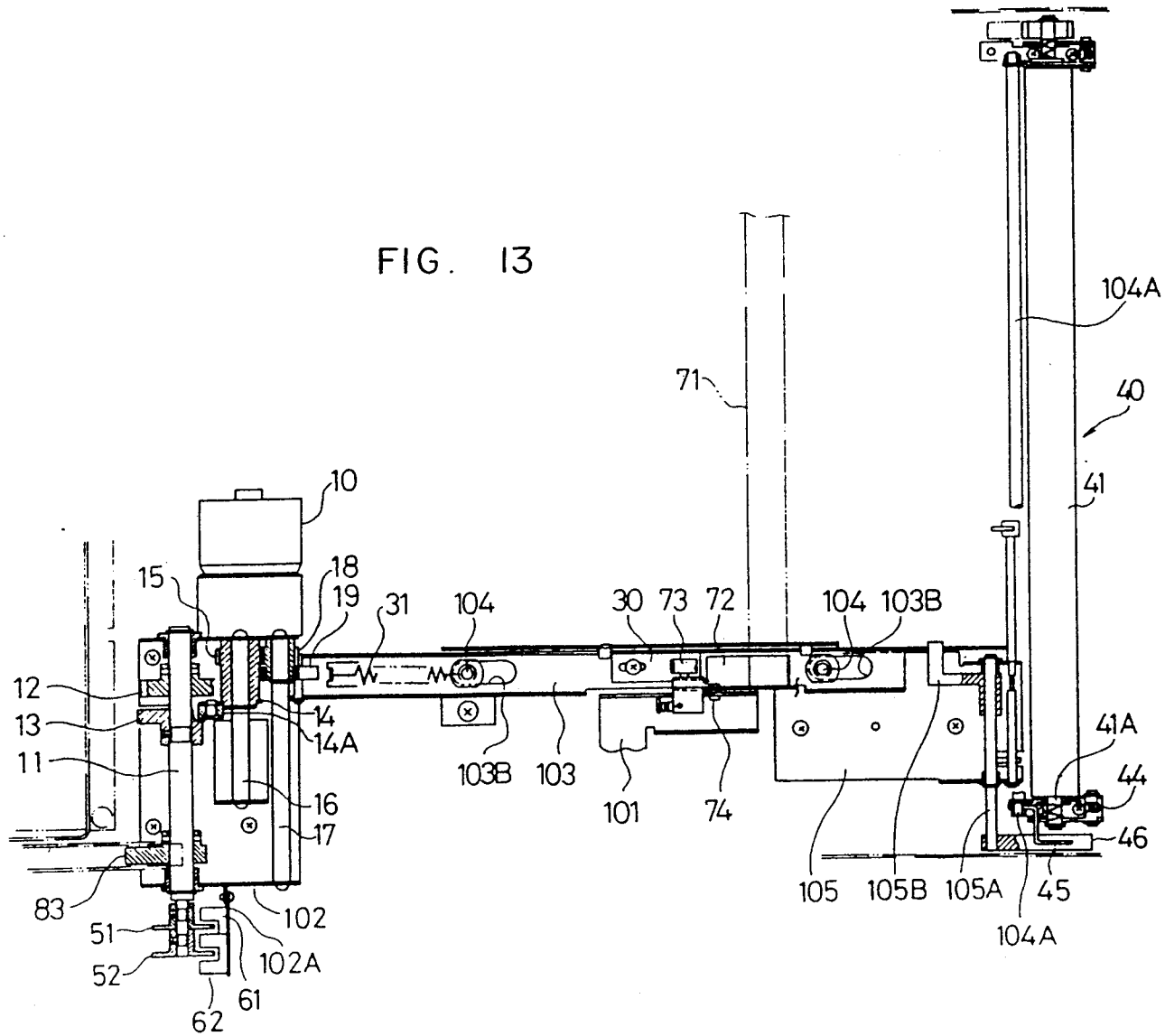
Figure 14:
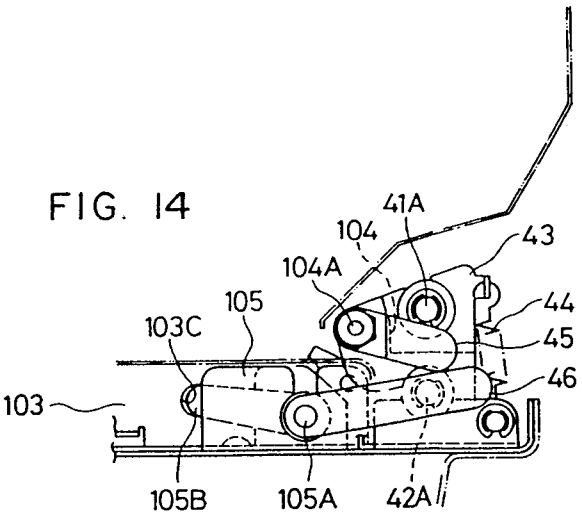
Figure 15:
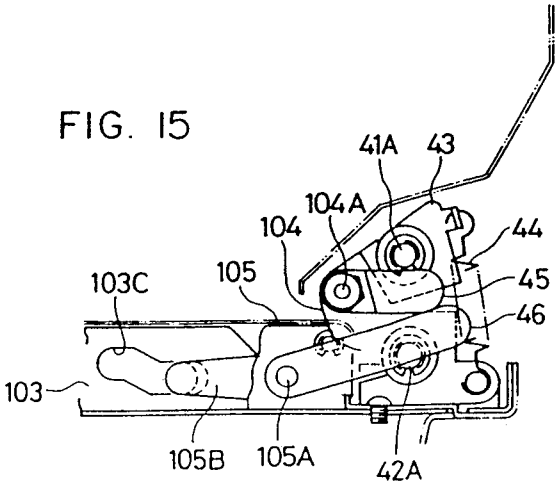
Figure 16:
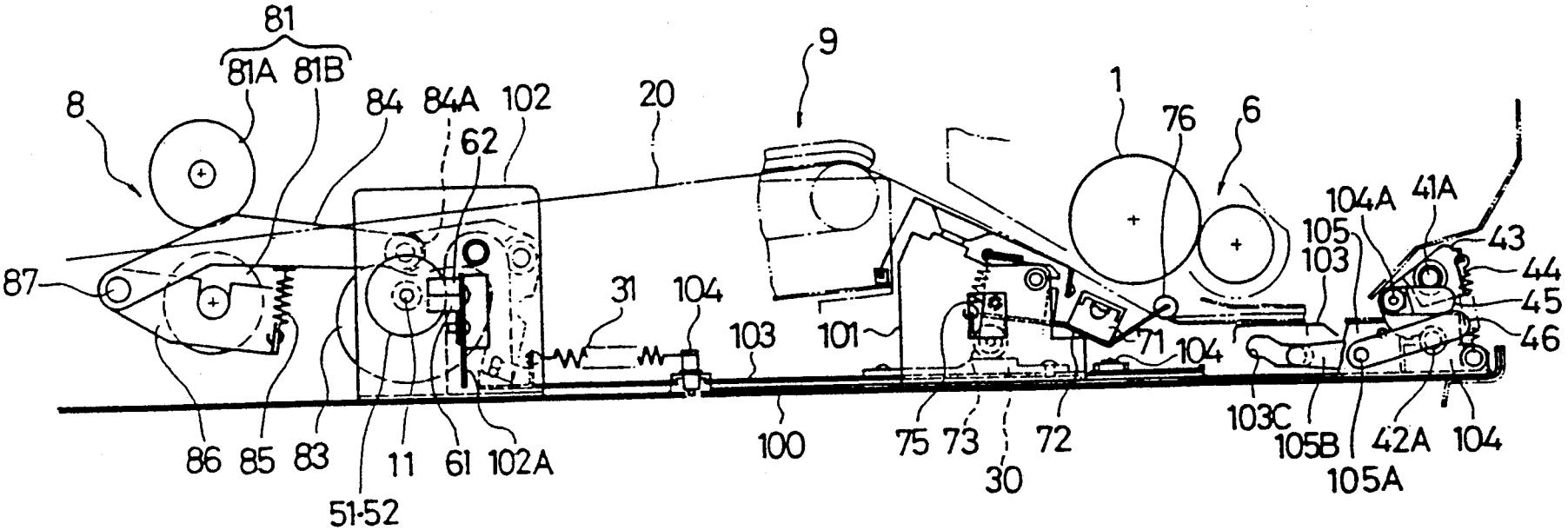
Figure 17:
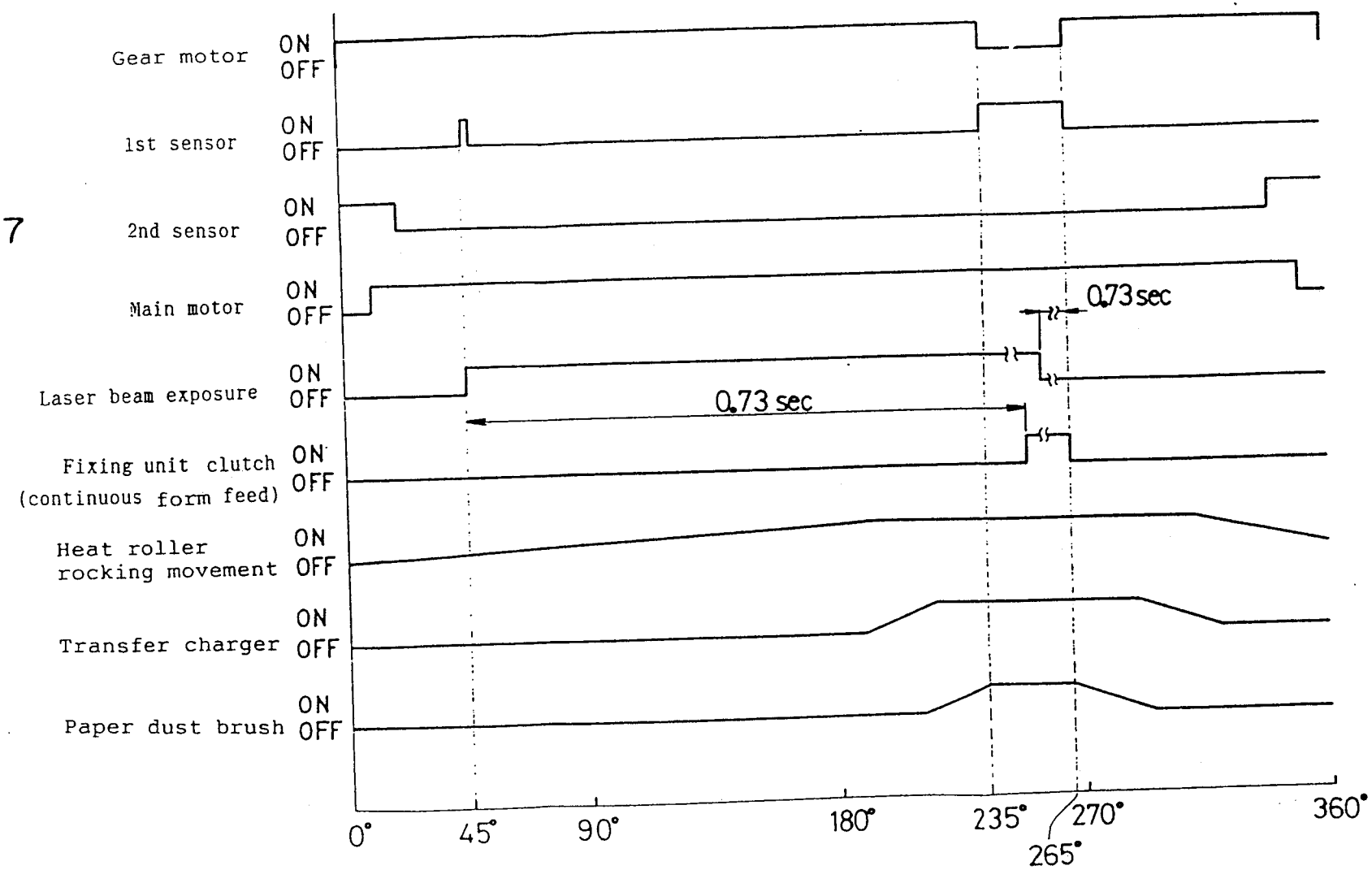
Figure 18:
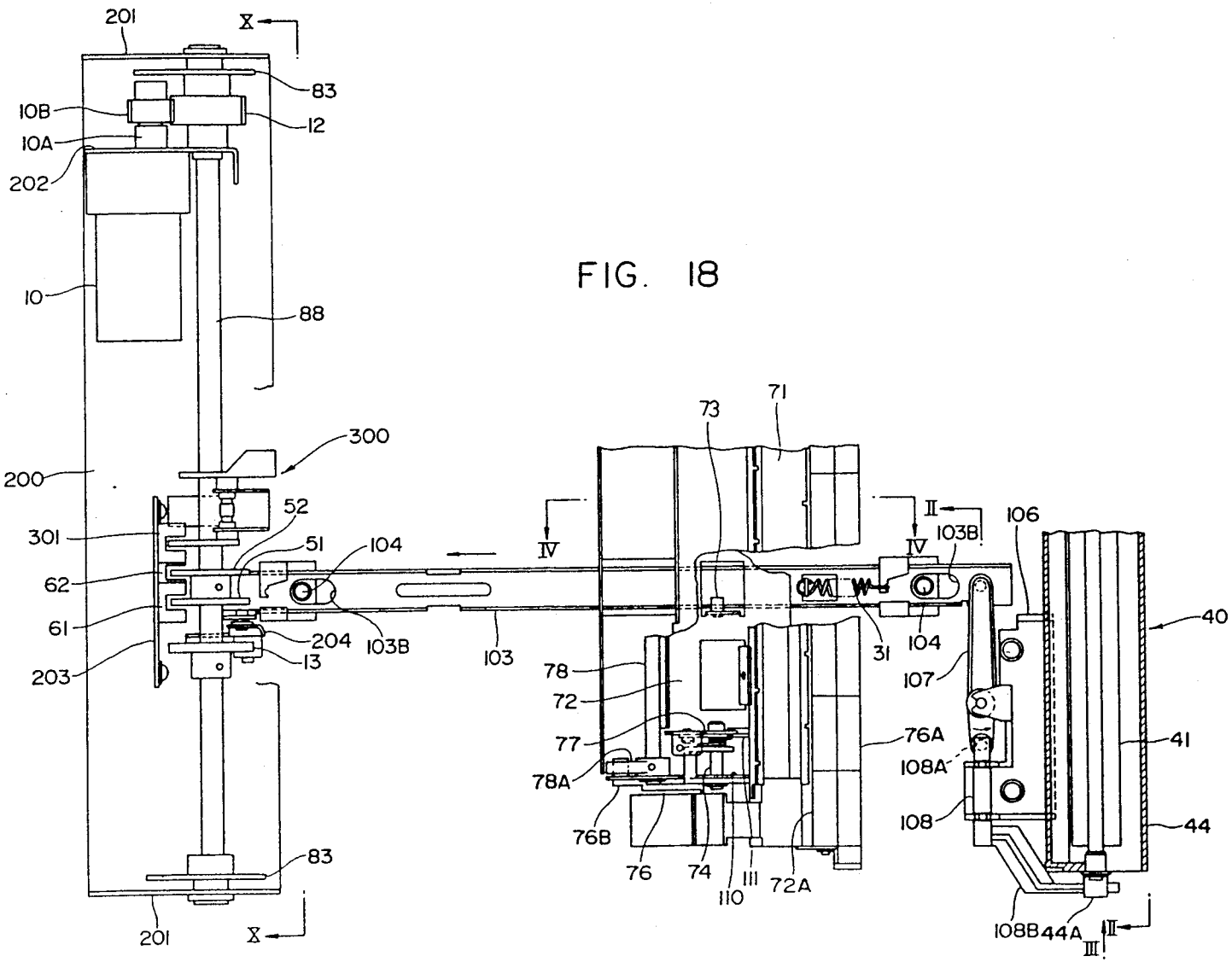
Figure 19:
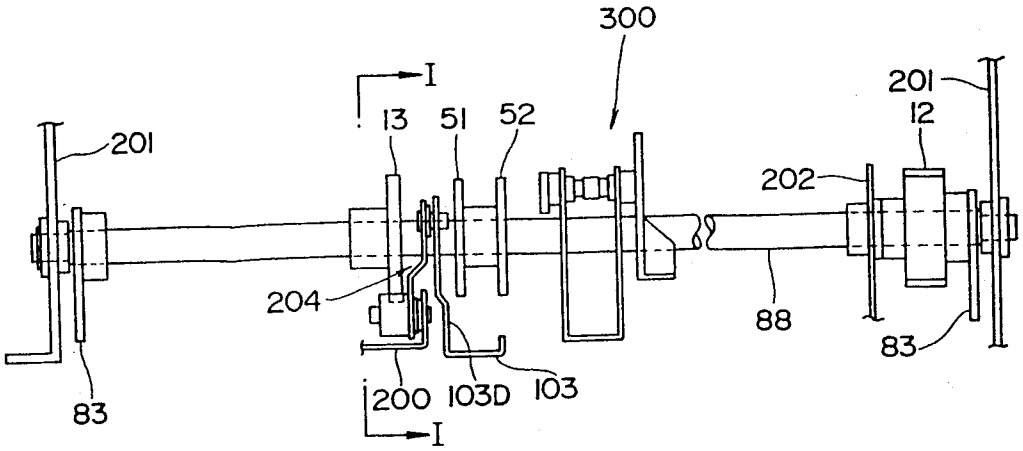
Figure 20:
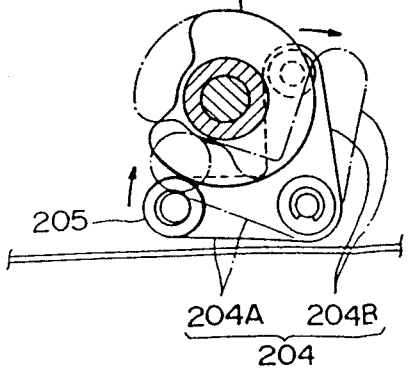
Figure 21:
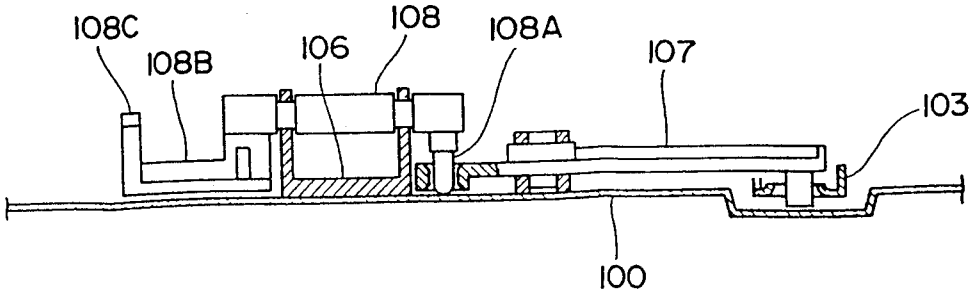
Figure 22:
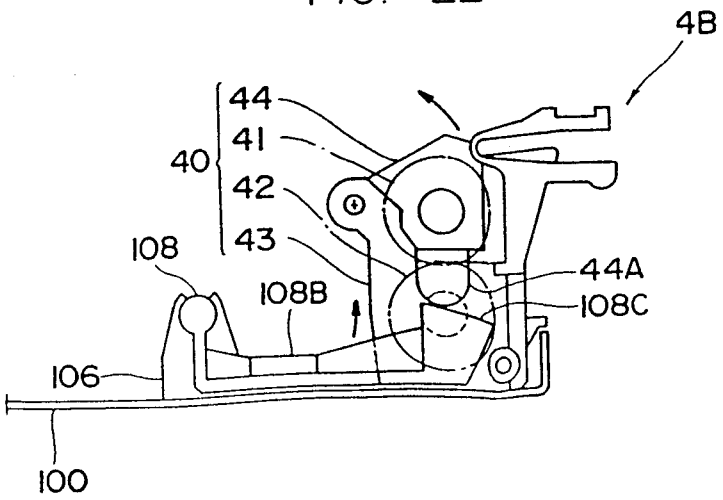
Figure 23:
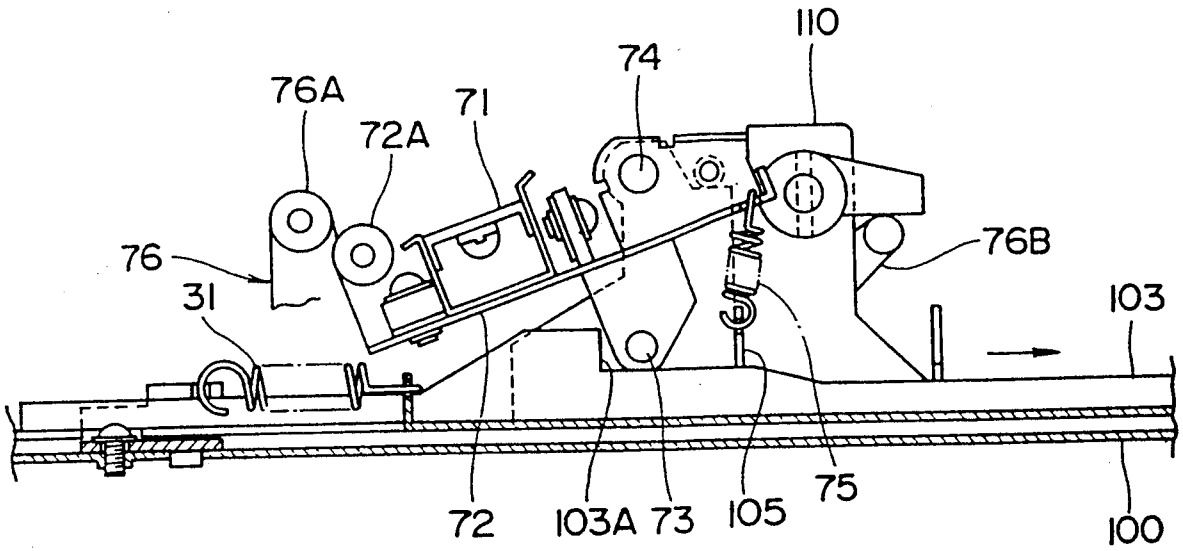
Figure 24:
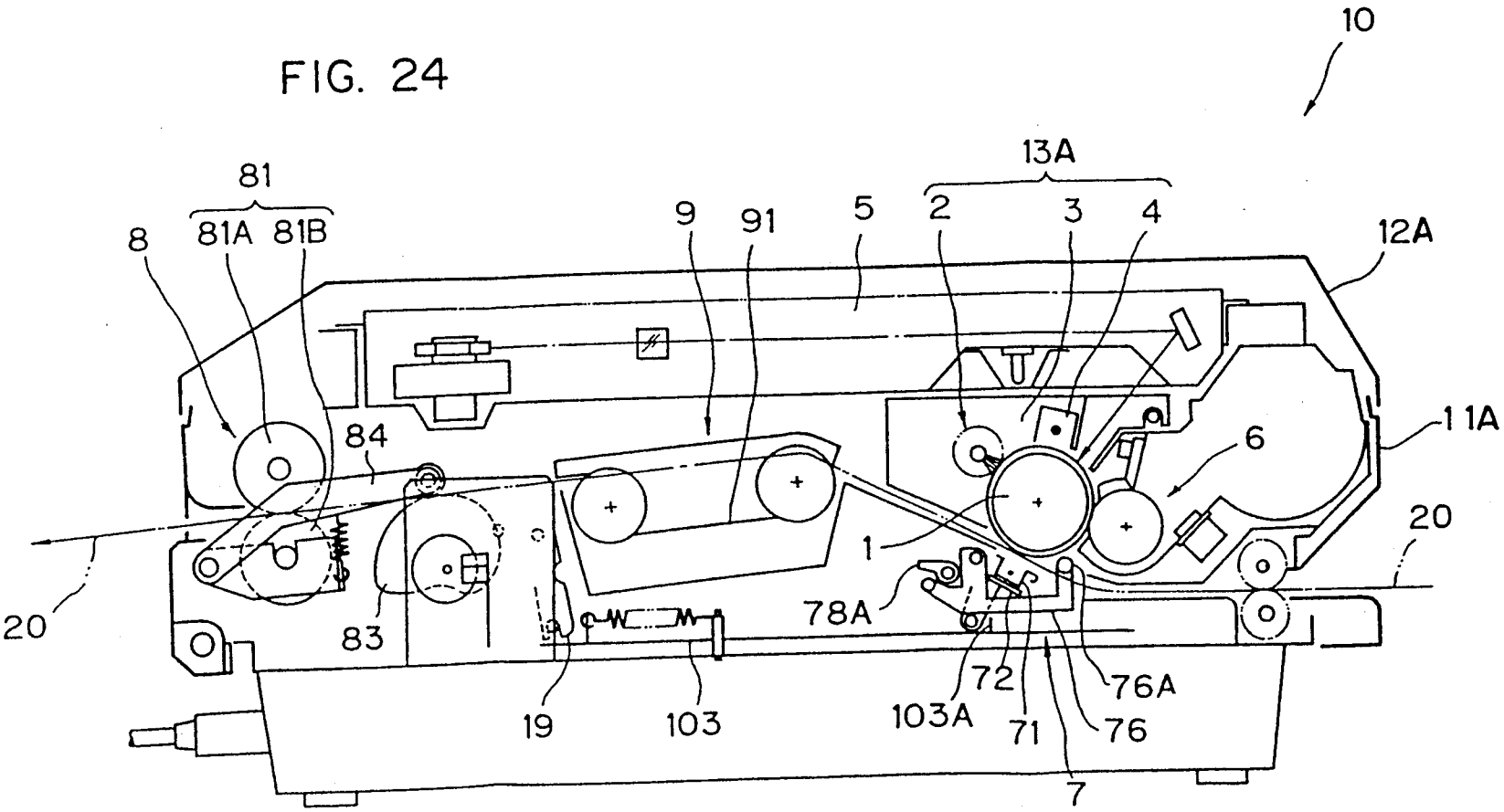
Figures 25A, 25B:
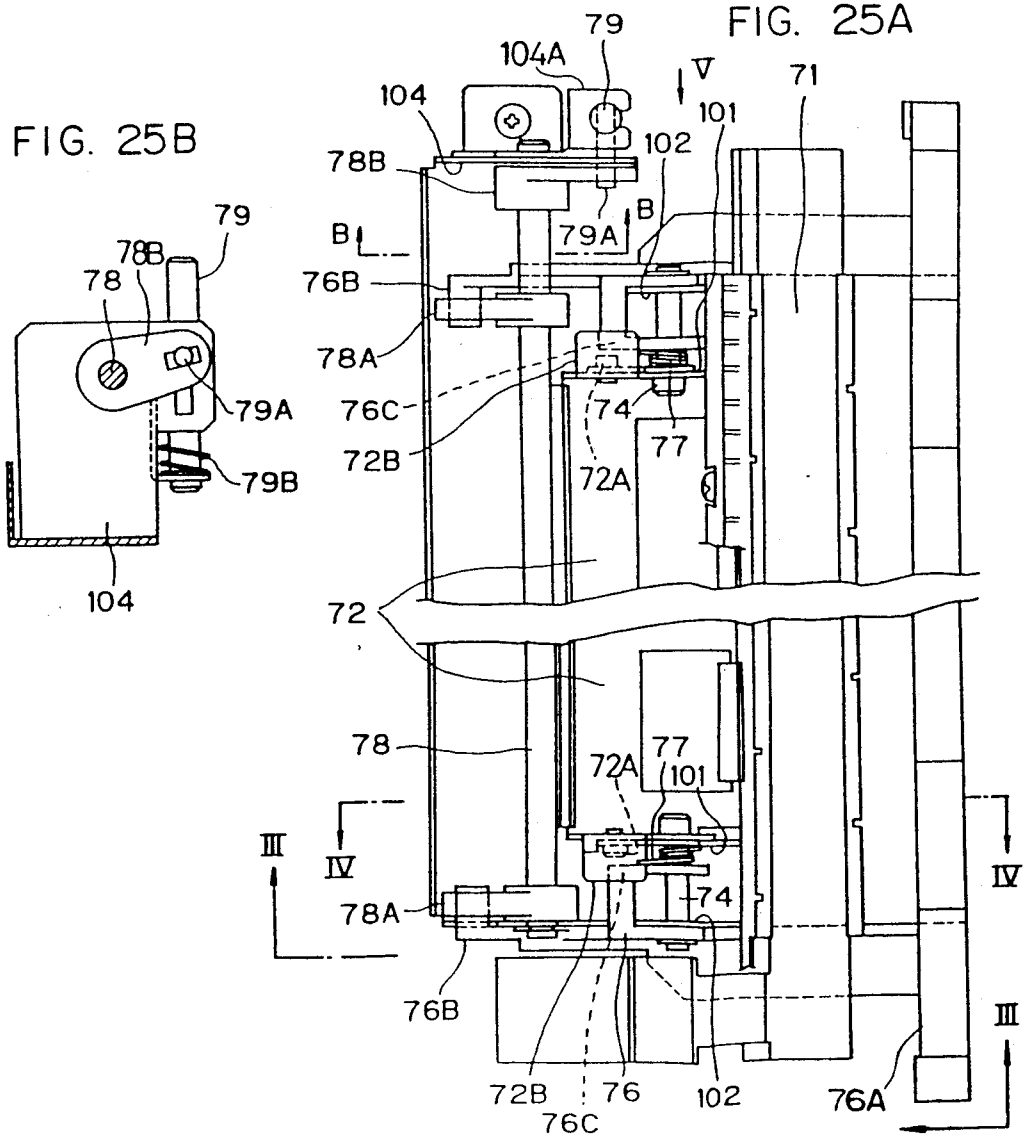
Figure 26:
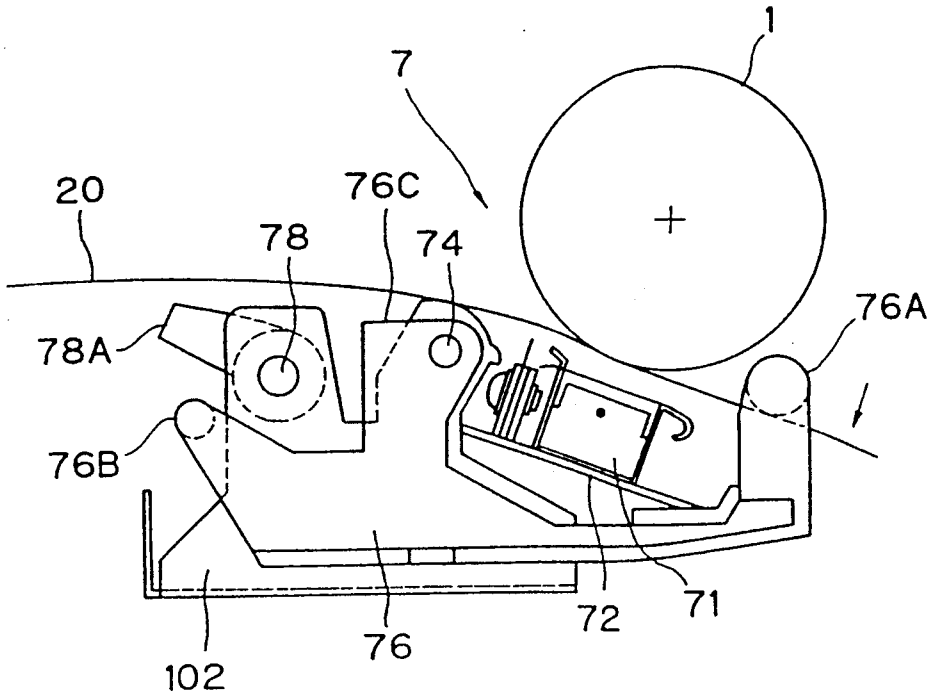
Figure 27:
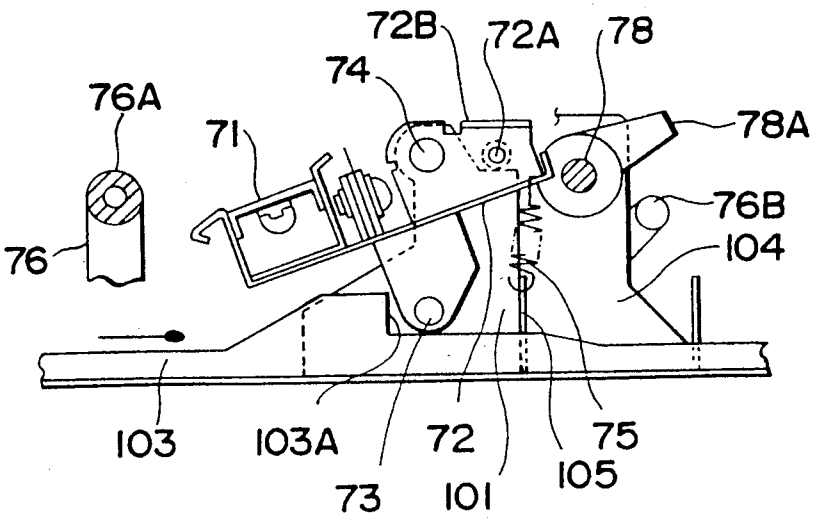

FIGS. 10(A) and 10(B) are partially enlarged views showing the paper holder in its withdrawn state;

FIG. 11 is an operational time chart showing the restoring operation of the corona charger and paper holder;

FIG. 12 is a side elevation of a modified continuous form withdrawing mechanism of the printer;

FIG. 13 is a plan view of FIG. 12;

FIG. 14 is an enlarged view of a dust brush unit of the printer;

FIG. 15 is a view illustrating the shifted state of FIG. 14;

FIG. 16 is a view showing the device of FIG. 12 in an operational condition;

FIG. 17 is an operational time chart of the printer of FIG. 6;

FIG. 18 is a plan view of a modified embodiment of the printer;

FIG. 19 is a section taken along X—X of FIG. 18;

FIG. 20 is a section taken along I—I of FIG. 19;

FIG. 21 is a section taken along II—II of FIG. 18;

FIG. 22 is a view in the direction of arrow III of FIG. 18;

FIG. 23 is a section taken along IV—IV of FIG. 18;

FIG. 24 is a side elevation showing a general configuration of a modified embodiment of the invention;

FIG. 25(A) is a side elevation of a paper holding mechanism;

FIG. 25(B) is a section taken along the line B—B of FIG. 25(A);

FIG. 26 is a section taken along the line III—III of FIG. 25(A);

FIG. 27 is section taken along IV—IV of FIG. 25(A); and

Figure 28:
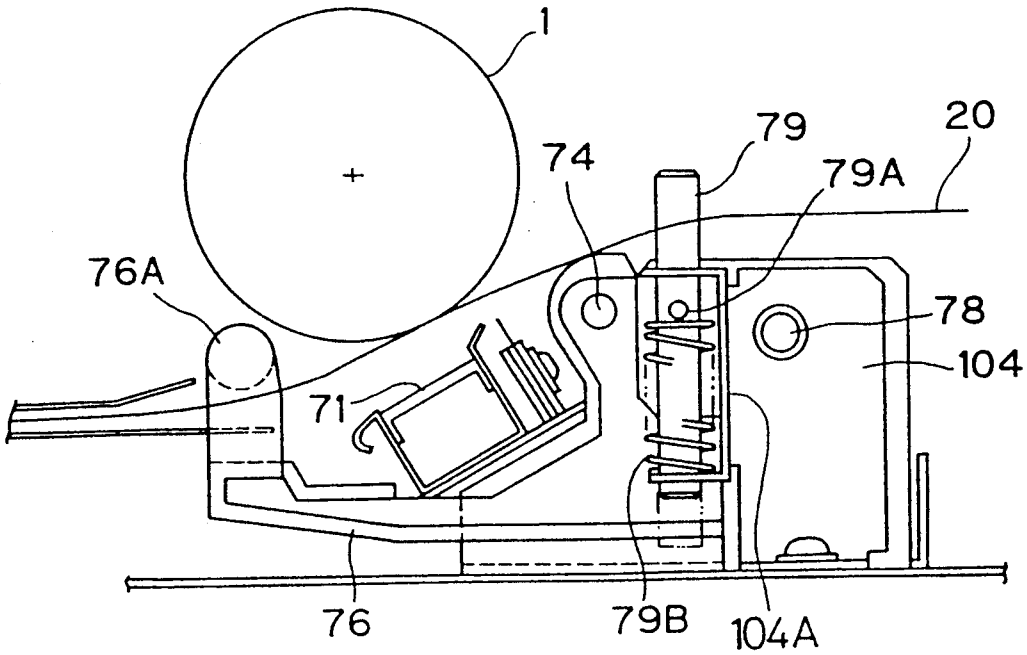

FIG. 28 is a view taken from the arrow V in FIG. 25(A) showing a transfer charger being withdrawn and a paper holder pivotally moved.

DESCRIPTION OF THE EMBODIMENTS

Figure 1:
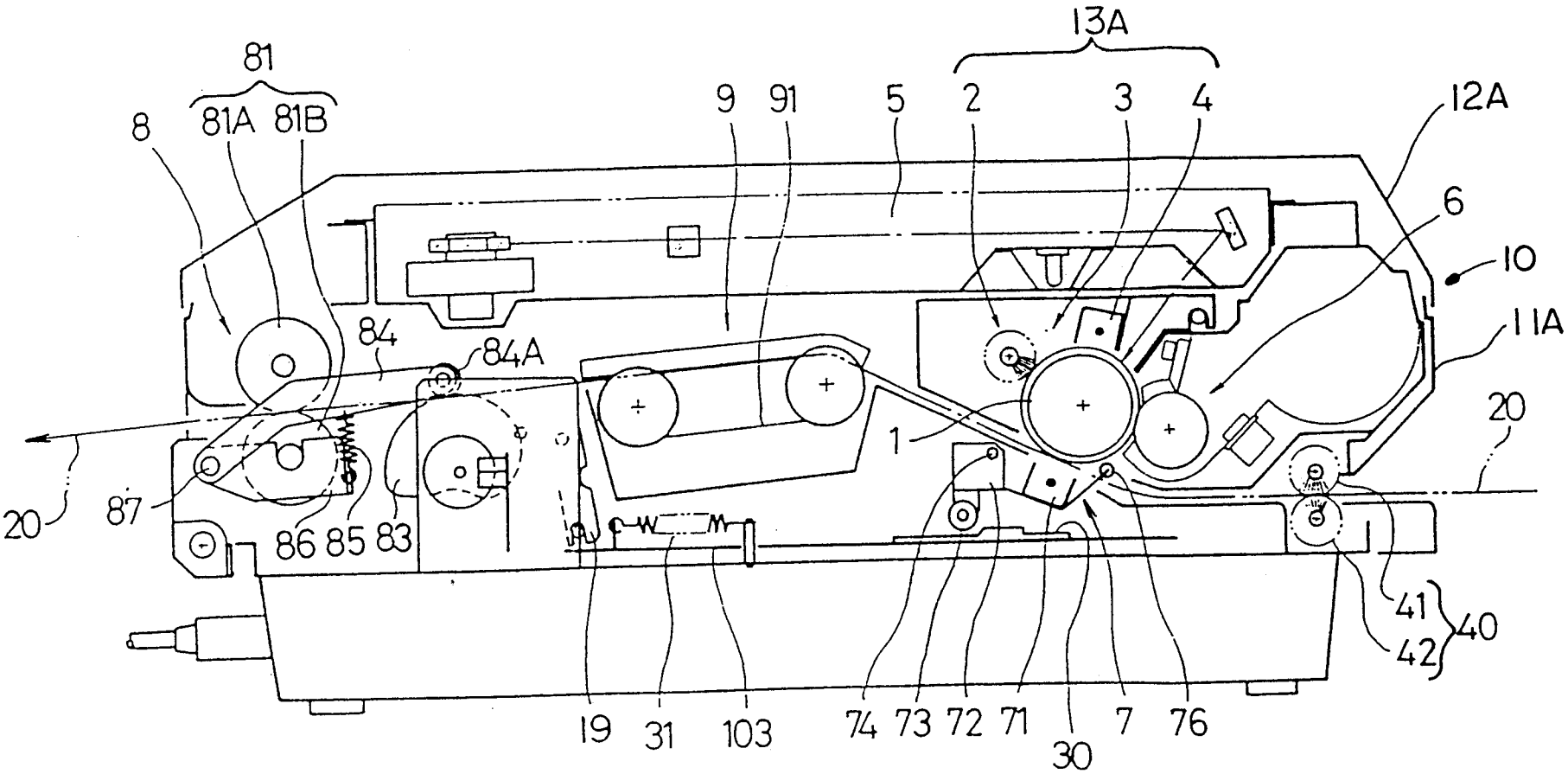
FIG. 1 is a side elevation showing a general configuration of a printer embodying the invention.

FIG. 1 shows a laser printer 10 using a continuous form 20 as a recording paper, which prints out information from computers etc. onto a continuous form 20 by means of a so-called electrophotographing process.

The laser printer 10 generally comprises a main body 11A as a lower structural part and a clam shell 12A as an upper structural part pivotally secured to the top of the main body 11A to allow opening movement relative to it. The main body 11A has formed therein a feed path of continuous form 20 running from right to left in the drawing. A drum unit is 13(A).

Along the outer circumference of a photoconductive drum 1 are a toner cleaning unit 2, a decharging unit 3, a charging unit 6, an optical scanning system 5, a developing unit 4 and a transfer unit 7, all arranged in due order in the rotary direction of the drum 1. A fixing unit 8 is placed ahead in feed direction of the continuous form 20, while a tension applying mechanism 9 is located in the feed path of the continuous form 20 form the drum 1 to the fixing unit 8. Near the inlet of the continuous form 20 (right-hand side of FIG. 1) provided is a paper dust brush pair 40.

The laser beam coming from the optical scanning system 5 effects horizontal scanning (exposure) on the photoconductive surface of the drum 1 along its rotary axis, while the drum 1 is rotated (vertical scanning). The latent image built on the photoconductive surface of the drum 1 is developed to a toner image by means of the developing unit 6. It is then transferred to the continuous form 20 at the transfer unit 7 and is fixed on it at the fixing unit 8. The tension applying mechanism 9 comprises a pair of endless belts 91 having projections adapted to be engaged with sprocket holes at the lateral ends of the continuous form 20, the belts 91 being capable of circulating with a certain resistance along the feed path of the continuous form 20. This is provided to prevent paper skew by giving a certain tension to the continuous form 20 drawn by the fixing unit 8.

The paper dust brush pair 40 comprises upper and lower cylindrical paper dust brushes 41 and 42 placed opposite to each other, whose lengthes are greater than the width of the continuous form 20. Both the paper dust brushes 41 and 42 are rotatably driven in the direction opposite to the feed direction of the continuous form 20 to be passed between the two brushes 41 and 42. The brushes 41 and 42 are thus adapted to sweep dust particles off the top and bottom surfaces (front and back surfaces) of the continuous form 20.

Figure 2:
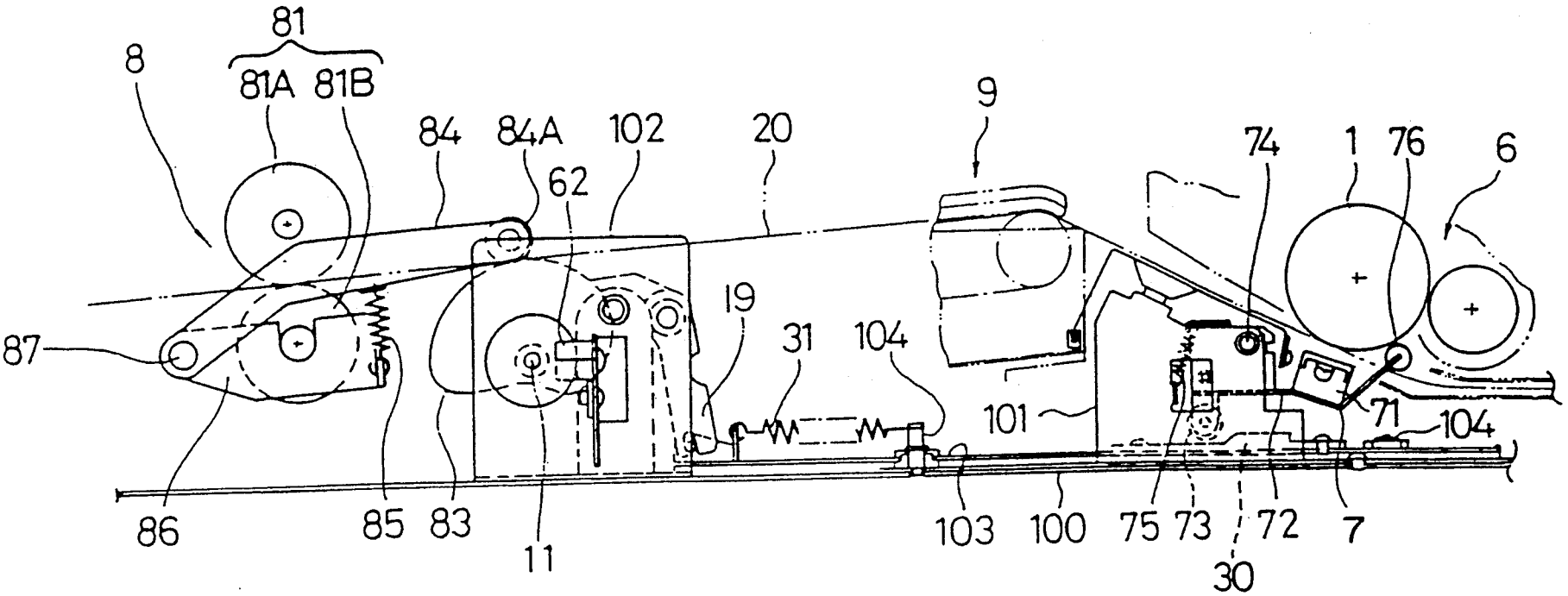
FIG. 2 is a side elevation of a continuous form withdrawing mechanism of a printer.
Figure 3:
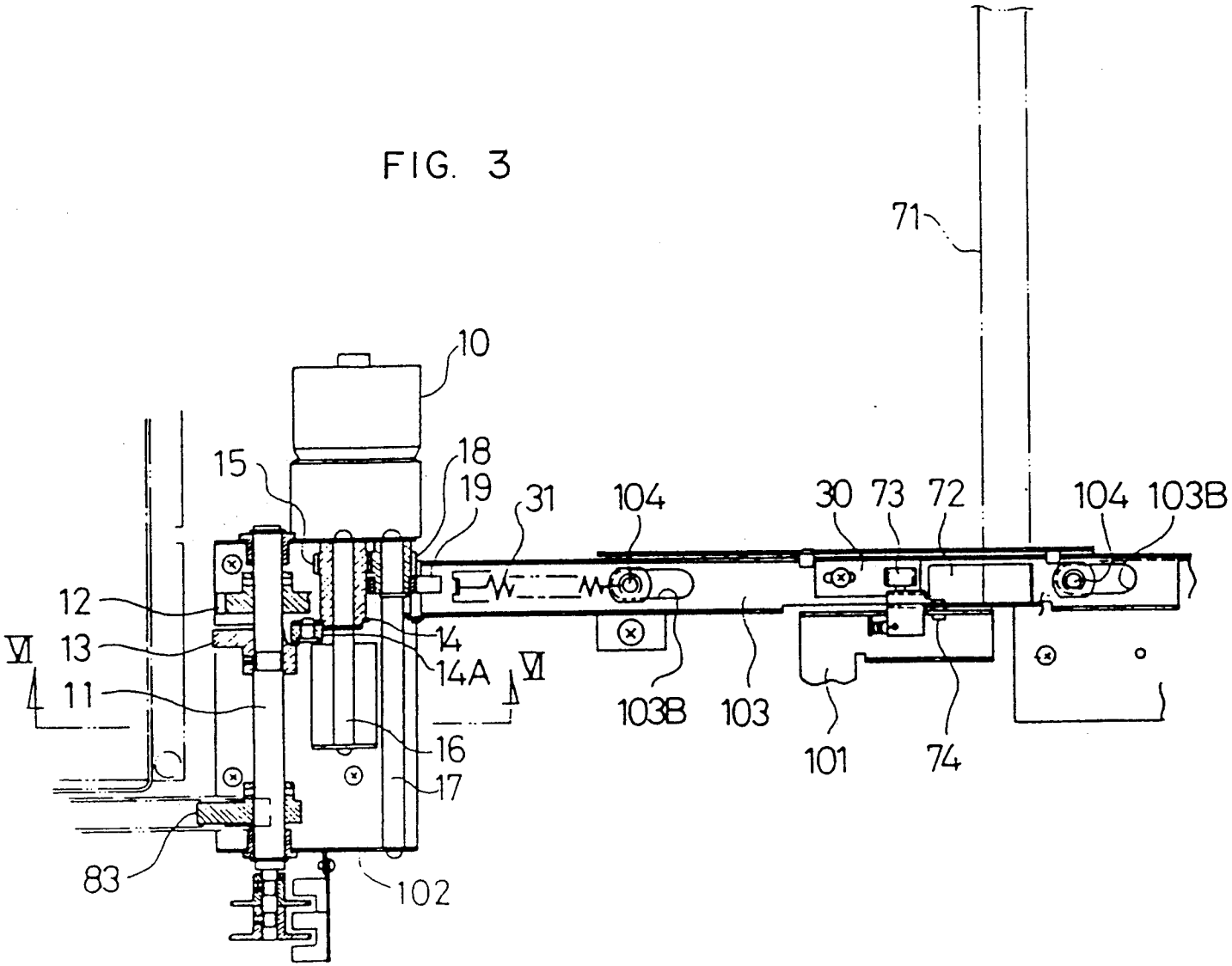
FIG. 3 is a plan view of FIG. 2.

The transfer unit 7 includes, as shown in FIGS. 2 and 3, a corona charger 71 substantially as long as the axial length of the drum 1, which is carried at both ends by arms 72 with a certain space away from the surface of the drum 1 in parallel therewith.

Each arm 72 is carried by a bracket 101 mounted on the chassis 100 of the laser printer 10 for pivotal movement about a pivot 74. The arm 72 is connected with the certain portion of the bracket 101 by means of a tension spring 75 so that the tension spring 75 preloads the arm 72 to bring the corona charger 71 retained by it to its transfer operating position with respect to the drum 1.

Under one end of the arm 72 provided is a rotatable cam follower 73 which is adapted to be operated by a cam plate 30 secured to the top surface of a slide plate 103 which is mounted on the chassis 100 to be slidably movable in fore and aft directions in the laser printer 10. Pivotal movement moves the arm 72 against the tension load of the tension spring 75. Pivotal movement of the arm 72 causes the corona charger 71 to be pivotally moved away from the drum 1, i.e. from its transfer operating position to its withdrawn position.

The leading end of the arm 72 has a paper holding roller 76 rotatably mounted thereon. The paper holding roller 76 is located at a certain distance from the corona charger 71 in parallel therewith and to be extended over the continuous form 20. When, the corona charger 71 is in its transfer operating position, the paper holding roller 76 is not in contact with the up-side of the continuous form 20. When the corona charger 71 is withdrawn from its transfer operating position because of pivotal movement of the arm 72, the roller 76 is brought into contact with the up-side surface of the continuous from 20 to push down the continuous form 20 in response to the withdrawing movement of the corona charger 71 (i.e., moving the continuous form 20 apart from the drum 1).

When in the arrangement mentioned above, the corona charger 71 is pulled down due to pivotal movement of the arm 72, the continuous form 20 is less charged with electricity even though a voltage is being applied to the corona charger 71. Since, the continuous form 20 is moved apart from the drum 1 upon push-down movement of the paper holding roller 76, image transfer is made virtually impossible.

The fixing unit 8 comprises a fixing roller pair 81 consisting of a heat roller 81A and a backup roller 81B vertically opposite to each other, both extending in perpendicular to the feed direction of the continuous form 20.

The upper heat roller 81A is a cylindrical roller, the both ends of which are rotatably carried by the chassis 100 of the laser printer 10. It houses therein a heating element such as a halogen lamp, not shown, which can be heated to a certain temperature. Another end of the heat roller 81A is coupled to a rotary drive means, not shown, so that it is rotated by the rotary drive means in the feed direction of the continuous form 20 at the circumferential revolution speed of the roller 81A, which is in synchronism with that of the drum 1.

The lower backup roller 81B is supported at each end by an arm 86 which is linked with a lever 84 vertically rockable upon rotation of a cam 83 against the biasing force of a tensions spring 85.

The lever 84 and the arm 86 are mounted on the chassis 100 of the laser printer 10 for pivotal movement about a same pivot 87. The leading end of the lever 84 is provided with a rotatable cam follower 84A which is adapted to contact the upper surface of the circumferential edge of the cam 83 because of the weight of the lever 84, the arm 86 and the backup roller 81B.

The arm 86 is at its leading end linked with the certain portion of the lever 84 by means of the tension spring 85 which in turn applies a preload to the arm 86 and the lever 84 so that the angle between them is decreased.

The cam 83 is of a generally heart-shaped eccentric type and is secured to a shaft 11 which is rotatably carried by a U-bracket 102 mounted on the chassis 100.

Figure 5:
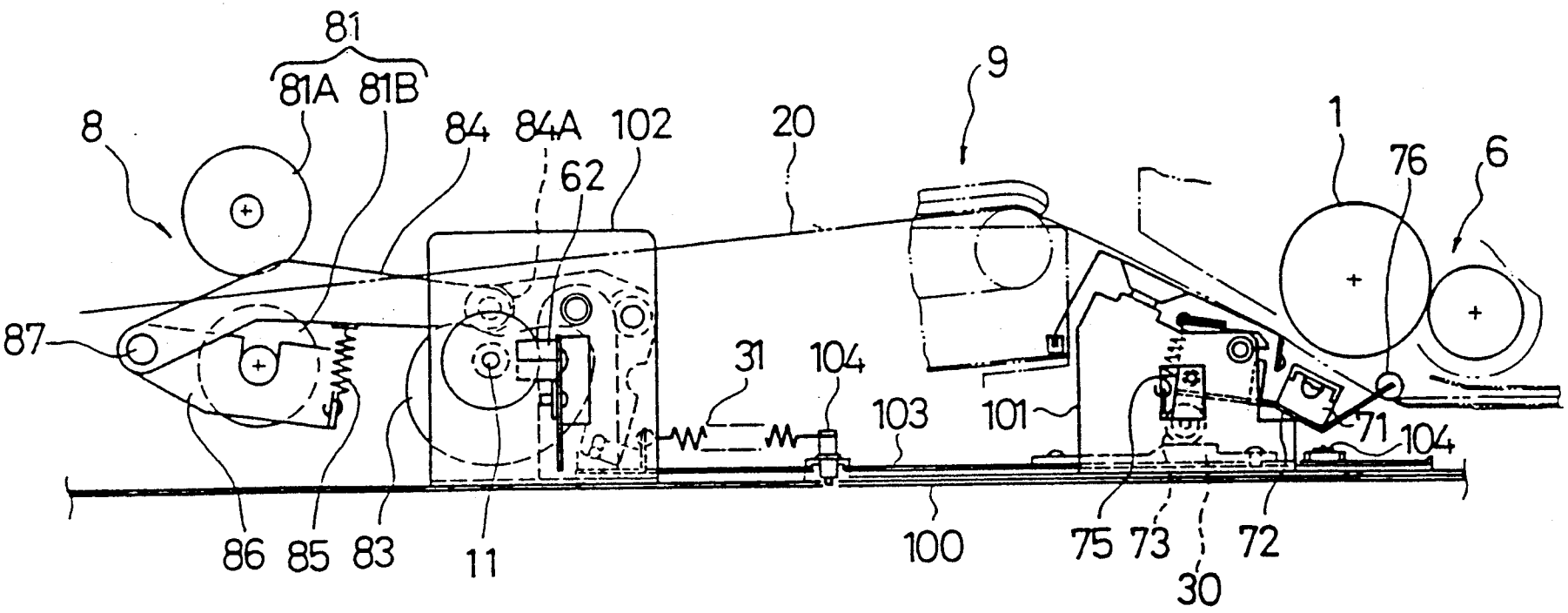
FIG. 5 is a side elevation of the printer showing the heating and backup rollers spaced apart.

When the cam 83 is in contact with the cam follower 84A at a top dead point (FIG. 2), the lever 84 is swung to upwardly rock the arm 86 via the tension spring 85. The backup roller 81B is thus pressed against the heat roller 81A under a certain force exerted by the tension spring 85, i.e., brought to its fixing operative position. The image-unfixed continuous form 20 clamped between the two rollers 81A and 81B is then heated to allow the toner image to be fused onto the continuous form 20, while at the same time the continuous from 20 is driven in its feed direction with rotation of the heat roller 81A. When the cam 83, on the other hand, contacts the cam follower 84A at a bottom dead point (FIG. 5), the backup roller 81B is moved apart from the circumferential surface of the heat roller 81A at a certain distance, i.e., brought to its withdrawn position where no fixing is effected. As the cam 83 is rotated, thus, the backup roller 81B is pivotally movable between its fixing position and its withdrawn position.

The shaft 11 (FIG. 3) has further mounted thereon a second cam 13 and a gear 12 in addition to cam 83. The gear 12 is in mesh with a gear, not shown, which is mounted to the flange-shaped spindle of a gear motor 10 secured to one side of the bracket 102, whereby rocking movement of the backup roller 81B is effected by the gear motor 10 through the shaft 11.

The gear motor 10 is in driving connection with a control unit, not shown, for the whole system, which is adapted to control other mechanical and operational parts of the laser printer 10.

Figure 4:
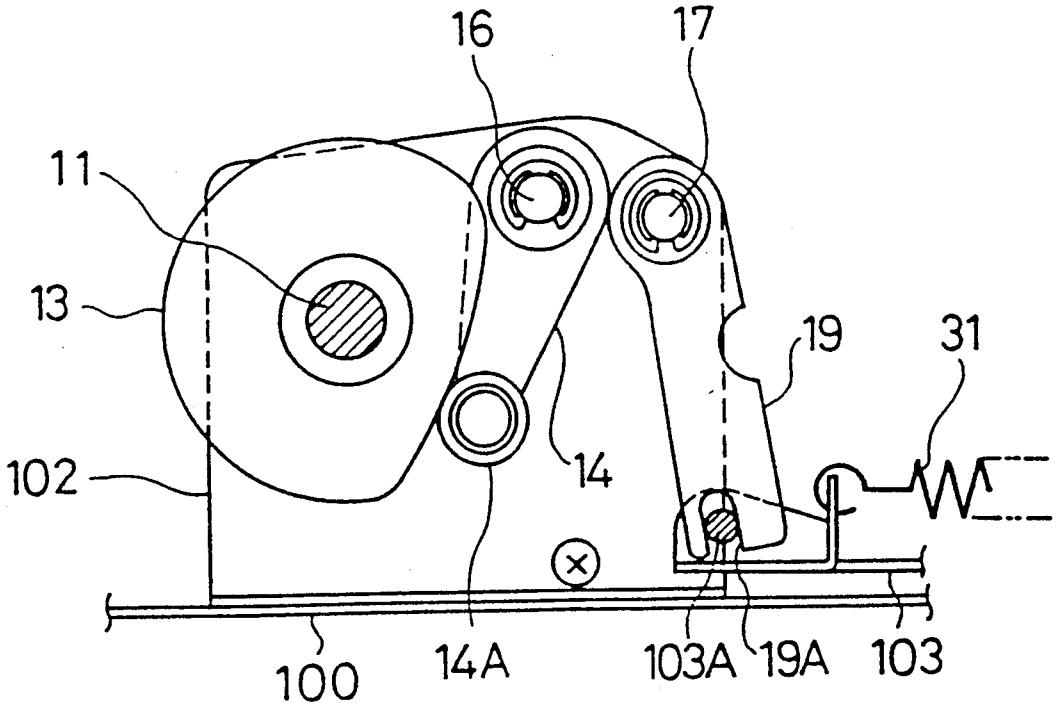
FIG. 4 is an enlarged section taken along VI—VI of FIG. 3.

The second cam 13, as shown in FIG. 4, is an eccentric cam generally of the same shape as the cam 83. In engagement with the circumferential surface of the second cam 13 is a cam follower 14A rotatably mounted on the leading end of a gear arm 14.

The gear arm 14 is secured to the side surface of a gear 15 splined to an arm shaft 16 which mounted on the bracket 102 in parallel with the shaft 11. The gear 15 is thus rotated upon rocking movement of the gear arm 14.

The gear 15 is in mesh with a gear 18 which is in turn rotatably splined to a lever shaft 17 mounted on the bracket 102 in parallel with the shaft 11 and the arm shaft 16.

The gear 18 carries a lever 19, the leading end of which is provided with a U-shaped cutaway 19A. In the cutaway 19A engaged is an operating lever 103A which is secured to the rear end of the slide plate 103.

The slide plate 103 is held in position by means of a guide shaft 104 mounted on the chassis 100, which is received by a guide slot **103*b* provided in the slide plate 103, so that it is slidably movable in fore and aft directions in the laser printer 10. On the other hand, another (rear) guide shaft 104 and the rear portion of the slide plate 103 are linked together by a tension spring 31, which applies a forward-directed load to the slide plate 103**.

With the arrangement mentioned above, the slide plate 103 is loaded in a forward direction by means of the tension spring 31 so that an operating bar **103*a* of the slide plate 103 pushes the lever 19 to aim the leading end thereof in a forward direction. This causes the gear arm 14 to be swung by way of gears 18 and 15 so that its leading end is aimed rearward, whereby the cam follower 14A at the leading end thereof is pressed against the cam surface of the second cam 13. That is, the cam follower 14A is pressed against the second cam 13 by means of the tension load of the tension spring 31, so that the slide plate 103 is slidably movable in fore and aft directions upon rotation of the second cam 13**.

With the configuration of the laser printer 10 as described above, in the print stand-by state, the gear motor 10 is driven to withdraw the backup roller 81B of the fixing roller pair 81 so as to separate the continuous form 20 from the heat roller 81A, while also withdrawing the corona charger 71 of the transfer unit 7 from its transfer operating position. This prevents not only the problems associated with continuous application of heat from the heat roller 81A to the same portion of the continuous form 20, but also the problems arising from contact of the continuous form 20 with the drum 1 even when only the drum 1 starts rotation while the continuous form 20 stands still when printing is started (re-started).

Figure 7:
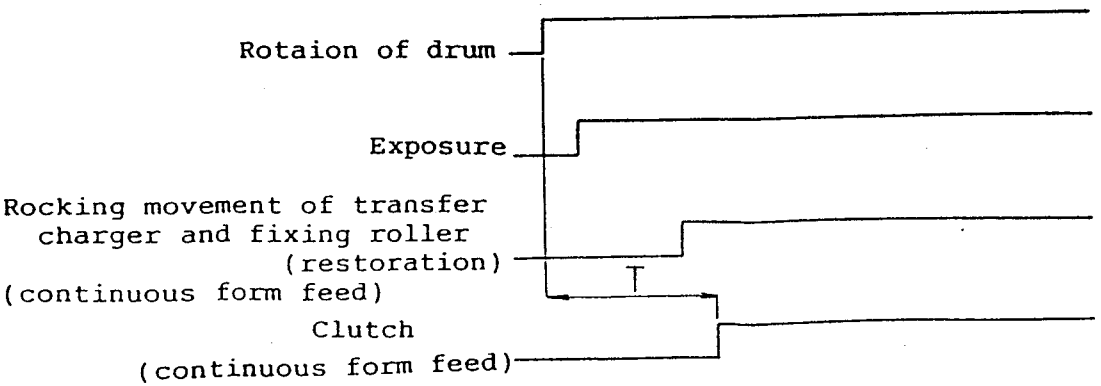

When starting (re-starting) printing, the corona charger 71 is put back to its transfer operating position and the backup roller 81B to its fixing operative position (i.e., fixing operation and continuous form drawing take place) at the timing shown in FIGS. 6 and 7.

In more particular, as shown in the time chart of FIG. 6, when a certain length of time (T) elapses since starting exposure with rotation of the drum 1, the gear motor 10 is driven to restore the corona charger 71 to its transfer operative position and the backup roller 81B to its fixing operative position, thus starting transfer and fixing operatiions as well as drawing of the continuous form 20. The heat roller 81A should be brought into rotation prior to pivotal movement of the backup roller 81B.

In this case, drawing the continuous form 20 starts at the time when the continuous form 20 is nipped between the heat roller 81A and the backup roller 81B because of pivotal movement of the latter. If pivotal movement of the backup roller 81B is here deviated from the timing of starting drawing the continuous from 20, it is difficult to ensure a constant space between the perforation and the print start (re-start) position on the continuous form 20. In order to prevent this and enable printing to start at a certain fixed distance from the perforation, the power transmission system to the fixing roller pair 81 (power transmission to the heat roller 81A in this embodiment) should preferably include a clutch, not shown, which is operated in accordance with the time chart shown in FIG. 7.

Specifically, before a certain length of time (T) elapses after start of exposure with rotation of the drum 1, the gear motor 10 is driven to put the corona charger 71 to its fixing operative position and the backup roller 81B to its fixing operative position. At this time, the clutch in the power transmission to the fixing roller pair 81 is OFF so that the fixing roller pair 81 is not in rotation and the continuous form 20 is not drawn. When the certain length of time (T) after start of exposure has elapsed, the clutch is ON to rotate the fixing roller pair 81 for drawing the continuous form 20.

While in the forgoing embodiment, the cam 83 for withdrawal of the backup roller 81B and the second cam 13 for pivotal movement of the corona charger 71 (withdrawing and restoring) are two different cams, only one cam may be used for effecting the both operations.

Also, while in the forgoing arrangement, the heat roller 81A of the fixing roller pair 81 is rotatably driven with the backup roller 81 adapted to be withdrawn, modification is possible for instance by making the backup roller 81B to be rotatably driven while the heat roller 81A is arranged to be withdrawn.

FIGS. 8 through 11 show a modified embodiment.

The aforedescribed embodiment is so arranged that withdrawing and restoring movements of the backup roller 81B of the fixing roller pair 81 and the corona charger 71 of the transfer unit 7 are accomplished by the cams (cam 83 and the second cam 13) rotatably driven by the single driving means (gear motor 10). Since the load applied to the driving means (gear motor 10) varies during the withdrawing and restoring movements, it is likely that this variation causes a subtle change in timing of restoration of the corona charger 71 especially if a DC (direct current) motor is used for such driving means. This may result in problems that the corona charger 71 could not come back to its operative position in time for print starting or so soon as to make the continuous form 20 be soiled.

This modified embodiment therefore intends to provide an arrangement in which the corona charger 71 is restored to its operative position at an accurate timing. In the drawings, like numerals indicate like and identical parts in the first embodiment explained above for simplicity of explanation.

There is a slide plate 103 which is fitted in guide elements 104 mounted in front and rear points of the chassis 100 for fore and aft sliding movements.

From one end of the slide plate 103 near the leading end of the continuous form 20 extends upright an operating element **103*a* for operating a pin 77*i* of a paper holder 77 to be described later. Its opposite end has an arm 103*b* extending upright therefrom, the tip end of which is provided with a rotatably carried cam follower 103*c***.

The leading end of the slide plate 103 in the paper feed direction is connected with a guide element 104 by means of a tension spring 31 which applies a tension load to the slide plate 103 to bias it backward, so that the cam follower **103*c* is brought into contact with the cam surface of the second cam 13 placed behind the arm 103*b***.

That is, the slide plate 103 is held in position through contact of the cam follower **103*c* with the second cam 13 by means of the tension spring 31. The fore and aft slide movements of the slide plate 103 are performed by rotation of the second cam 13 as in the first embodiment. The second cam 13 in this embodiment is so shaped that its contact face (cam surface) with the cam follower 103*c* varies from its smaller-diameter portion to larger-diameter portion in its rotational direction. It then returns to its small-diameter portion after the larger diameter portion continues through a certain angle. The drive means (DC motor) for rotatably driving the second cam 13 also serves for withdrawing and restoring movements of the roller 81B of the fixing unit 8**.

The operating member **103*a* of the slide plate 103 is located downstream, slightly behind the pivot center 74 on which the arm 72 of the transfer unit 7 is rockably mounted on the bracket 101 of the chassis 100 so that the operating member 103*a* is moved forward by a certain degree upon slide movement of the slide plate 103**.

The transfer unit 7 is at its both ends carried by the arm 72 which is pivotally mounted on the bracket 101 upright by extending from the chassis 100 for pivotal movement about the pivot center 74, as in the first embodiment. It is positioned at a certain distance from the drum 1 in parallel therewith. The corona charger 71 is loaded toward its transfer operative position by means of a spring 75 interposed between the arm 72 and the chassis 100 as a transfer charger biasing means. Forward of the position of the arm 72 at which it carries the corona charger 71, provided is a paper pressure guide element 78 which, together with a roller **77*d* of the paper holder 77 to be described later, bends the feed path of the continuous form 20 to bring it into close contact with the transfer position of the drum 1 when the corona charger 71 is in its transfer operative position. A rib-shaped guide member 78*a* which extends forward of the paper pressure guide element 78 and is placed on the coroner charger 71, is to prevent the leading end of the continuous form 20 from being pulled into the corona charger 71 during loading the form 20. Designated by numeral 79 in the drawing is a brush made of a conductive flexible material, which is placed to be brought into contact with the continuous form 20 after image transfer to electrically decharge the continuous form 20** through grounding.

The paper holder 77 is pivotally mounted on the same pivot 74 by which the arm 72 is pivotally mounted on the bracket 101.

The paper holder 77 comprises a plurality of rollers **77*d* which are rotatably mounted to a shaft 77*c* connected between roller holders 77*b* which are provided by upwardly bending the both ends of a paper holder bracket 77*a*. It is pivotally mounted on the pivot center 74 at the bracket 101 by means of a bent attachment portion 77*e* adjacent the roller holders 77*b* for pivotal movement independent of the arm 72**.

The reason why the paper holder 77 is mounted on the same pivot center (74) as that of the arm 72 (corona charger 71) for pivotal movement independent of each other is that the paper holder 77 (roller 77B) allows the feed path of the continuous form 20 to be bent for close contact of the continuous form 20 with the drum 1 in its transfer position for a maximum transfer effect. The paper holder 77 must be sufficiently withdrawn, to remove, on one hand, the continuous form 20 from its transfer position in the print stand-by (when the corona charger 71 is withdrawn), and on the other hand, not to be in the way of the continuous form 20 during loading of the form 20. However, sufficient withdrawal is not attained because of the difference between the distances from the pivot center (74) if the paper holder 77 is fixedly mounted on the arm 72 for withdrawal together with the corona charger 72.

The paper holder bracket **77*a* is located below the arm 72. The leading ends of the roller holders 77*b* extend above the arm 72 through a narrower portion formed by partly cutting away its end and through a cutaway of the arm 72 to thereby retain the roller holders 77***d* in position.

Between the paper holder bracket 77*a* and the chassis 100 interposed is a compression spring 77*f* as a pressure guide biasing means so that the paper holder 77 is pivotally biased upward by means of the compression spring 77*f*. A contact portion 77*g* between the roller holders 77*b* of the paper holder bracket 77*a* and the attachment portion 77*e* thus abut against a stopper 101*a* which is formed by inwardly bending the upper end of the bracket 101. The rollers 77*d* are thus positioned forward and upward of the transfer position of the drum 1 by certain degrees.

The paper holder bracket 77*a* is provided with a bent-down lever 77*h*, on one side of which the pin 77*i* is horizontally planted. When the slide plate 103 is moved in the same direction as feeding of the continuous form 20 by means of the second cam 13, the operating member 103*a* is brought into contact with the pin 77*i* to operate the same, so that the paper holder 77 is pivotally swung to move the rollers 77*d* down.

Figure 8:
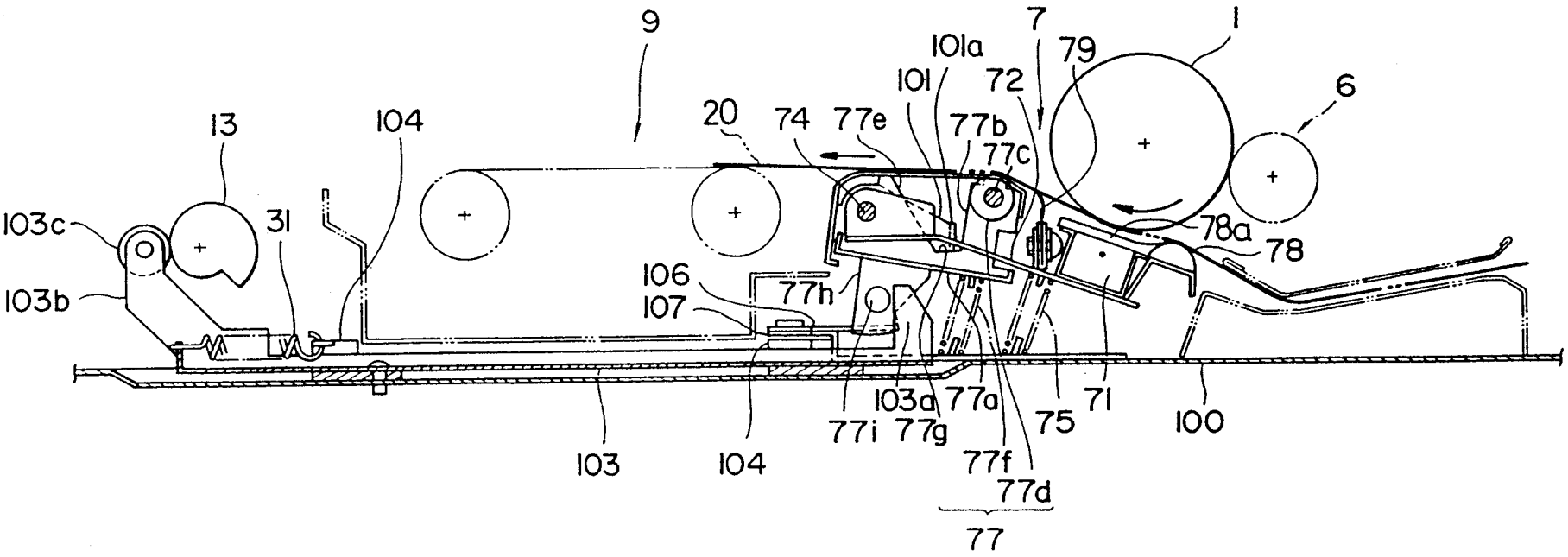
FIG. 8 is a side elevation of a modified embodiment of the printer.
Figure 9:
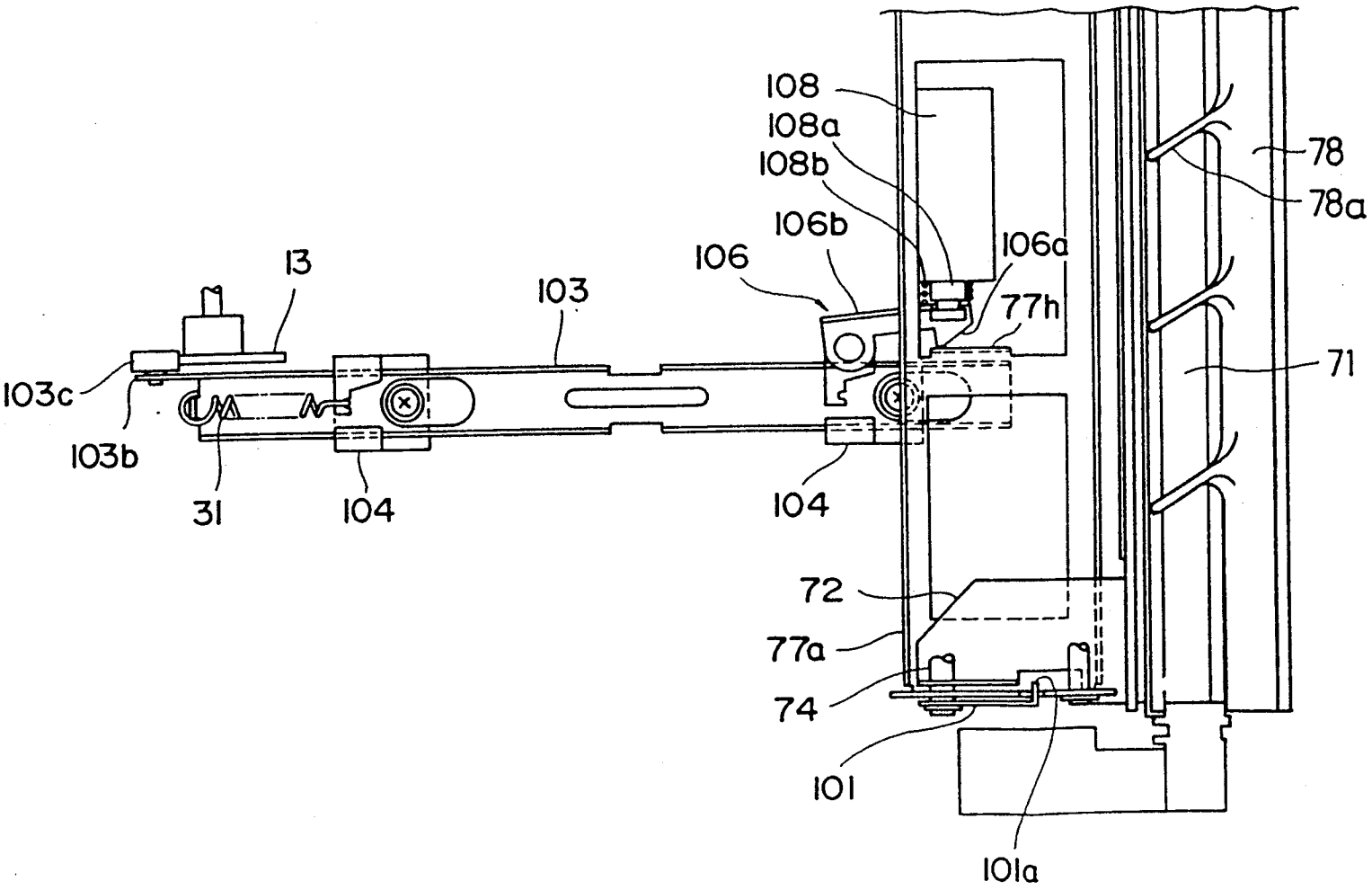
FIG. 9 is a plan view thereof of FIG. 8.

On the side of the lever 77*h* provided is a hook 106 as pressure guide lock means, which is carried by a bracket 107 mounted on the chassis 100 for pivotal movement in a horizontal direction, as shown in FIG. 9 equivalent to the plan view of FIG. 8.

The hook 106 is provided at one end with a hook-shaped contact portion 106*a* and opposes to the lever 77*h*. The hook 106 is at the other end rotatably mounted on the bracket 107. The back side of the contact portion 106*a* has formed an upright-bent rib 106*b*. Engaged with an upward opening cutaway formed at the rib 106*b* is the tip end of a rod 108*a* of a solenoid 108 as lock releasing means fixedly mounted on the chassis 100.

Between the front end face of the solenoid 108 and the rib 106*b* of the hook 106 interposed is a coil spring 108*b* surrounding the rod 108*a*, which normally biases the hook 106 to move the contact portion 106*a* thereof toward the lever 77*h*. When the solenoid 108 is energized, the hook 106 is rotatably moved apart from the lever 77*h* against the biasing force of the coil spring 108*b*. When the mechanism is ready to print (when the corona charger 71 is in its transfer operative position), rotation of the hook 106 by the biasing force of the coil spring 108*b* is prevented by the tip end of the contact portion 106*a* contacting the lever 77*h*.

During printing, the cam follower 103*c* of the slide plate 103 contacts to the small-diameter portion of the second cam 13. At this time, the slide plate 103 is moved back by the spring load of the tension spring 31 so that the operating element 103*a* is apart from the pin 77*i* of the paper holder 77 to keep it in its inoperative position. Thus, the paper holder 77, the corona charger 71 and the arm 72 are all in their operative positions by means of the biasing force of the springs (75, 77*f*). In other words, the corona charger 71 takes its transfer operative position with respect to the drum 1, while at the same time, the continuous form 20 is brought into contact with the drum 1 in a position just opposite to the corona charger 71 (transfer position) by means of the paper pressure guide element 78 placed rearward of the corona charger 71 and the roller 77*d* of the paper holder 77 located forward thereof.

In a print stand-by state, the transfer unit 7 and the paper holder 77 are withdrawn from the positions stated above upon rotation of the second cam 13.

With rotation of the second cam 13, the slide plate 103 is slidably moved forward so that the operating element 103*a* engages with the pin 77*i* of the lever 77*h* for forward operation thereof. As a result, the paper holder 77 first starts pivotal withdrawing movement by itself and after moving through a certain angle (5 degrees in this embodiment), the upper end 77*j* of the narrow portion cutaway of the roller holder 77*b* of the paper holder bracket 77*a* is brought into contact with the arm 72. Thereafter, the arm 72 is pushed by the paper holder 77 for pivotal movement (both together), so that the corona charger 71 begins to withdraw. When the lever 77*h* is further moved pivotally to have its rear face positioned forward of the contact portion 106*a* of the hook 106, the hook 106 is rotated by the biasing force of the coil spring 108*b*. The contact portion 106*a* is then moved into the moving area of the lever 77*h* for contact therewith. This prevents the paper holder 77 and the arm 72 from rocking back to their operative positions to maintain the withdrawn states (shown in FIG. 10(A)). The pivoting angles of the paper holder 77 and the arm 72 during withdrawing movements are 15 and 10 degrees, respectively.

When starting printing, the cam 13 is rotated in advance so that it contacts the smaller-diameter portion of the cam follower 103*c* of the slide plate 103. When the solenoid 108 is energized to rotate the hook 106 apart from the lever 106 to release the contact, the paper holder 77 and the arm 72 are instantly moved back to their operative positions because of the biasing force of the springs (75, 77*f*) loading them toward the operative positions.

Movement of the transfer unit 7 (corona charger 71) and the paper holder 77 back to their operative positions is now described with reference to the time chart shown in FIG. 11. In this embodiment, feeding the continuous form 20 is carried out by the fixing unit 8, but start and stop of rotation of the roller 81A are performed by ON/OFF change of the clutch, not shown, interposed between the roller 81A and the drive means. As has been described above, drive means for rotatably driving the second cam 31 also serves to drive the cam 83 for withdrawing and restoring the roller 81B in the fixing unit 8. A sensor fixedly mounted on the chassis 100 checks a member attached to the drive shaft 11 to detect restoration of the roller 81B as well as the position at which the second cam 31 contact the cam follower 103*c* of the slide plate 103.

When a certain period passes after starting rotation of the drum 1, the second cam 31 begins to rotate and is brought to a stop when a signal from the sensor for detecting its rotation indicates that it has rotated to a predetermined position. This stop position detected by the sensor is a position where the roller 81B in the fixing unit 8 is returned to its fixing operative position and the second cam 31 contacts the cam follower 103*c* of the slide plate 103 at its smaller-diameter portion.

Exposure starts at a certain time after starting rotation of the second cam 31, and drawing the continuous form 20 starts at a certain time after start of the exposure through the clutch in the fixing unit 8. Furthermore, the solenoid 108 is energized at a certain time after start drawing of the continuous form 20 ("t" seconds after start of the exposure: determined by the circumferential speed of the drum 1 and the circumferential distance between the exposure unit 5 and the transfer unit 7), whereby the transfer unit 7 (corona charger 71) and the paper holder 77 are restored to their operative positions while at the same time energizing the corona charger 71.

As described above, according to the printer embodying the invention, withdrawing the continuous form from the drum at the transfer unit and from the heat roller in the print stand-by state can be accomplished by a single driving means, whereby it is possible to provide at a lower cost a printer using a continuous form of recording paper that is able to prevent damage and wear of the drum as well as problems associated with heat applied to the continuous form of recording paper.

Also, since the transfer charger is loaded by loading means to its transfer operative position, while the transfer charger is locked by locking means in its withdrawn position and the transfer charger is restored to its transfer operative position by releasing lock of the transfer charger by means of the lock release means, restoring the transfer charger when starting printing can be accomplished at a correct timing.

Furthermore, the pressure guide is rockably mounted on the same pivotal axis as that of the arm member for pivotal movement independent of the arm member, wherein rockable withdrawing movement of the pressure guide causes the arm member to be rockably withdrawn, so that the pressure guide is sufficiently withdrawn during loading the continuous form of recording paper.

FIGS. 12 through 16 show another embodiment of the invention wherein the paper dust brush 41 is also withdrawn from its operative portion during the print stand-by state. Like reference numerals indicate like and identical parts in the first embodimant.

As shown in FIGS. 12 and 13, the lower dust brush 42 is so mounted on the chassis 100 that its shaft 42A is rotatably carried by a bracket 104 extending upright from the chassis 100. The paper dust brush 42 is rotatably driven by rotary means, not shown, in the direction opposite to the feed direction of the continuous form 20 as stated before.

The upper paper dust brush 41 has its shaft 41A at its rear end rotatably retained by right and left arms 4 pivotally amounted on the bracket 104.

The other end of the arm 43 is connected with the chassis 100 by means of a spring 44 as shown in FIG. 14. The arm 43 is thus loaded by the spring 44 to be pivotally moved downward (toward the lower paper dust brush 42). The arm shaft 104A as a pivot axis by which the arm 43 is pivotally mounted on the chassis 100 has one end fixedly carrying a lever 45, which is not rotatable relative to each other at a certain angle between them.

Below the lever 45 provided is a lever operating arm 46 whose one end is secured to a connecting shaft 105A rotatably mounted on a bracket 105 fixed to the chassis 100. Rocking movement of the lever 45 is restricted by contact with the top surface of a lever operating arm 46 by means of the load of the spring 44. Therefore, the position of the lever 45, i.e., the position of the paper dust brush 41 carried by the arm 43 is determined by the position of the lever operating arm 46 (the angle through which it swings about the connecting shaft 105*a*).

The other end of the connecting shaft 105*a* has a crank-shaped follower arm 105*b*. The tip end of the follower arm 105*b* is then fitted in a cam slot 103*c* opening to an upright portion of the slide plate 103 which is pivotally moved by the second cam 13 secured to the chassis 100 in fore and aft directions in the laser printer 10. The cam slot 103*c* continues on the slide plate 103 in its sliding direction with a change in its certain relative positions. As the slide plate 103 slides, the tip end of the follower arm 105*b* moves up and down accordingly. This up and down movements allow the paper dust brush 41 to be pivotally moved up and down by means of the connecting shaft 105*a*, the lever operating arm 46 and the lever 45.

When the paper dust brush 41 is in its down position (as shown in FIG. 14), it grips the continuous form 20 with the paper dust brush 42 to sweep the surface of the continuous form 20 with the paper dust brushes 41 and 42 removing the dust particles deposited thereon. When it is moved up (as shown in FIG. 15), the paper dust brush 41 is completely separated from the surface of the continuous form 20. Rotational movement of the paper dust brush 41 is performed through meshing engagement of a gear, not shown, which is secured to one end of the shaft 41A with the same drive power source as rotatably driving the paper dust brush 42. Thus, as the paper dust brush 41 is pivotally swung upward, the gear becomes out of engagement to stop the transmission of the rotational force, thereby stopping rotation of the paper dust brush 41.

Furthermore, the shaft 11 mounting cams 83 and 13 thereon is provided with first and second sensor plates 51 and 52 both in disc-shape which are secured to one end projecting outward of the bracket 102. Sensors 61 and 62 each consists of a so-called photo-interrupter which has a light emitting portion and a light receiving portion placed opossite to each other at the ends of the legs of an inverted-C shaped frame. They detect the cutway portion formed at a certain position of the sensor plates 51 and 52 and generates detection signals.

Since the sensor plates 51 and 52 are secured to the shaft 11, their rotations are in complete synchronsim with that of the cam 83 secured to the shaft 11 and the second cam 13. This makes it possible to detect the operating state of the structural parts (the paper dust brush pair 40, the transfer unit 7 and the fixing unit 8 driven by the cam 83 and the second cam 13 when the sensors 61 and 62 detect the cutways formed at an arbitrary position of the sensor plates 51 and 52.

In one sensor plate 51, the cutway portion is so formed that it generate a signal immediately after the backup roller 81B starts moving up (when the cam 83 and the second cam 13 rotate at the angle of 45 degrees), and when the structural parts (the paper dust brush 40. the transfer unit 7 and the fixing unit 8) driven by the cam 83 and the second cam 13 are all in their operative positions (when the rotary angle of the shaft 11, i.e., that of the cam 83 and the second cam 13 is in the range of 235 to 265 degrees).

In the second sensor 52, on the other hand, the cutaway portion is so formed that it generates a signal when the backup roller 81 is entirely in its withdrawn position (when the rotary angles of the cam 83 and the second cam 13 are in the ranges from 0 to 20 degrees and from 340 to 0 degrees).

With the configuration of the laser printer as described above, in the print stand-by state, the gear motor 10 is driven to withdraw the backup roller 81B of the fixing roller pair 81 so as to separate the continuous form 20 from the heat roller 81A, while also withdrawing the corona charger 71 of the transfer unit 7 from its transfer operating position. Also, the upper paper dust brush 41 of the paper dust brush pair 40 is moved to its withdrawn position.

The operational timing of the structural parts will be described with reference to FIG. 17. In the drawing, the ordinate indicates the rotary angle of the shaft 11 (the cam 83 and the second cam 13).

When a command for starting print is received from the control unit for the whole system, not shown, rotation of the motor 10 begins so that the cam 83 and the second cam 13 are rotated upon rotation of the shaft 11. Around the same time as this, a main motor for rotating the drum 1 also starts driving.

When the shaft 11 rotates by the motor 10, the backup roller 81B of the fixing roller pair 81 operatively driven by the cam 83 beings to move upward from its withdrawn position. At this time, the second sensor 62 sensing the second sensor plate 52 is producing a signal. When the rotary angle of the shaft 11 (cam 83) reaches approximately 20 degrees, this signal disappears to indicate that the backup roller 81B begins to move upward from its withdrawn position.

With further rotation of the shaft 11 (cam 83) to reach its rotary angle of 45 degrees, the sensor 61 sensing the first sensor plate 51 produces a signal. Receiving this signal allows the exposure of the drum 1 to the laser beam from the scanning optical system 5 to start. At a certain time after this signal (1.73 seconds), the clutch for rotatably driving the heat roller 81A of the fixing unit 8 is brought into ON-state. This time of 0.73 seconds after starting exposure is a period in which the position where the surface of the drum 1 exposed to the laser beam reaches the transfer position (transfer unit 7).

As soon as the rotary angle of the shaft 11 (cam 83) reaches approximately 190 degrees, the backup roller 81B is pushed against the heat roller 81A and in its fixing operative position. In approximate synchronism with this, the corona charger 71 of the transfer unit 7 begins to pivotally move upward. The corona charger 71 reaches its transfer operative position when the rotary angle of the cam 83 becomes approximately 215 degrees.

With the rotary angle of the shaft 11 at about 210 degrees, the upper paper dust brush 41 of the paper dust brush pair 40, driven by the slide plate 103 which is moved by the second cam 13, begins to rockably move downward, and the paper dust brush 41 reaches its predetermined position (cleaning operative position) when the rotary angle of the shaft 11 becomes 235 degrees.

That is, when the rotary angle of the shaft 11 becomes 235 degrees, all the structural parts (the paper dust brush pair 40, the transfer unit 7 and the fixing unit 8) driven by the cam 83 and the second cam 13 are all in their operative positions. This state lasts until the rotary angle of the shaft 11 becomes 265 degrees.

The rotary angle of the shaft 11 reaches 250 degrees which is about the middle of the range in which all the structural parts are in their operative positions. This time corresponds to the time of 0.73 seconds after producing a signal output from the first sensor 61, which in turn corresponds to the time at which the rotary angle of the shaft 11 is 45 degrees. At this timing, the clutch for rotatably driving the heat roller 81A of the fixing unit 8 is brought into ON-state, so that the heat roller 81A begins to rotate to start drawing the continuous form 20 into a nip between the fixing rollers 81. That is, the exposure start position on the surface of the drum 1 reaches the transfer unit 7 via the developing unit 6, while at the same time the continuous form 20 is fed to effect printing.

The motor 10 is kept inoperative during printing.

When printing is complete, at the time of 0.73 seconds after finishing exposure of the drum 1 to the laser beam from the optical scanning system 5, the clutch for rotatably driving the heat roller 81A of the fixing unit 8 is brought into OFF-state, so that drawing of the continuous from 20 by means of the fixing roller pair 81 is brought to a stop. Rotation of the motor 10 is restored in advance, so that the rotary angle of the shaft 11 reaches 265 degrees when drawing of the continuous form 20 stops.

With rotation of the shaft 11, the structural parts are brought to their withdrawn positions in the reverse order to above. That is, when the rotary angle of the shaft 11 reaches 265 degrees, the upper paper dust brush 41 of the paper dust brush pair 40 starts pivotal upward movement (withdrawal). At 290 degrees of the rotary angle, the corona charger 71 of the transfer unit 7 starts withdrawing movement, and further at about 310 degrees of the rotary angle, the backup roller 81B of the fixing roller pair 81 starts withdrawing movement. When the rotary angle reaches about 340 degrees, a signal is given by the second sensor 62 to indicate the withdrawal movement of the backup roller 81B.

About the same time as the withdrawing movement of the backup roller 81B, rotational movement of the drum 1 by a main motor is brought to a stop. At the rotary angle of 360 degrees, the motor 10 stops to make it ready for restarting printing.

FIGS. 18 through 23 show a modification of the embodiment stated above with reference to FIGS. 12 through 17. Like reference numerals indicate like and identical parts in the first embodiment for simplicity of explanation.

As shown in FIG. 18, the fixing unit 8 includes a shaft 88, on which the cam 83, the second cam 13, the first sensor plate 51 and the second sensor plate 52 are fixedly mounted in their predetermined positions. The shaft 88 is rotatably carried by side plates 201 extending upright from the both sides of a unit chassis 200. The shaft 88 is rotatably driven by the motor 10 which is carried by a motor bracket 202 extending at right angle to the shaft 88 near one side of the unit chassis 200.

There are provided two of the cams 83 swinging the backup roller 81B of the fixing unit 8, which are generally of the same shape and mounted near the both ends of the shaft 88 for stable swinging movement of the backup roller 81B at its both ends.

The second cam 13, the first sensor plate 51 and the second sensor plate 52 are arranged in a row approximately in the center of the shaft 88.

Behind the position where the first and second sensor plates 51 nad 52 are located in the unit chassis 200 vertivally extends a sensor holder 203 which is provided with the first sensor 61 and the second sensor 62 in the positions corresponding to the first sensor plate 51 and the second sensor plate 52 respectively.

Around the center of the shaft 88 beyond the second sensor plate 52 and the second sensor 62 installed is a recording paper detecting mechanism 300 whose sensor 301 is also carried by the sensor holder 203 together with the first sensor 61 and the second sensor 62 side by side.

The motor 10 is a flange-type pulse motor which is fixedly carried by the motor bracket 202 as mentioned above. The motor 10 has its spindle 10A passing through and projected from the motor bracket 202. To the spindle 10A secured is a gear 10B in mesh with a gear 12 fixedly mounted on the shaft 88 in its corresponding position. The shaft 88 is thus rotatably driven by the motor 10.

Below the portion of the shaft 88 carrying the second cam 13 mounted is and L-shaped lever 204 which is, as shown in FIGS. 19 and 20, pivotally carried at its apex point by means of the unit chassis 200 for rocking movement in fore and aft directions.

The lever 204 has a cam follower 205 rotatably mounted on the leading end of the substantially horizontally extending lower arm 204A. The leading end of the generally vertically extending upper arm 204B is pivotally linked with the upper end of an upright arm 103*d* of the slide plate 103 mounted on the chassis 100 for fore and aft movements.

Here, the cam follower 205 is located in a position corresponding to the second cam 13 and the slide plate 103 is located forward by means of the spring 31. This allows the lever 204 to be rockably pushed to bring the cam follower 205 into contact with the outer circumferential surface of the second cam 205. Thus, displacement of the second cam 13 causes fore and aft sliding movements of the slide plate 103.

The slide plate 103 at its front end receives one end of the lever 107 carried by the bracket 106 secured to the chassis 100 for horizontal pivotal movement (rocking movement about a vertical axis). The lever 107 is thus rockably moved upon sliding movement of the slide plate 103.

The other end of the lever 107 receives an engagement projection 108A projected at right angle from the shaft 108 at one end thereof, which shaft 108 is rotatably carried by the bracket 106 carrying the lever 107 for rotation in horizontal and right and left directions. The shaft 108 is thus rotatably moved by rocking movement of the lever 107.

The other end of the shaft 108 is provided with an arm 108B extending forward. The leading end of the arm 108B is thus swung up and down by rotation of the shaft 108.

That is, the leading end of the arm 108B is swung up and down by fore and aft movements of the slide plate 103.

The leading end of the arm 108B is located opposite to the lateral end of the paper dust brush pair 40.

As shown in FIG. 22, the paper dust brush pair 40 has a box-shaped lower holder 43 made of synthetic resin and an upper holder 44 rockably carried by the lower holder 43, while the paper dust brush 41 is rotatably carried by the upper holder 44. At the end of the upper holder 44 opposite to the leading end of the arm 108B provided is an operating projection 44A laterally projecting therefrom. An operating portion 108C at the leading end of the arm 108B is contactable with the arc-shaped undersurface of the operating projection 44A.

Thus, when the arm 108B is swung upward, the operating portion 108C at its leading end pushes up the operating projection 44A up so that the upper holder 44 (paper dust brush 41) is swung upward toward its withdrawn position.

The upper holder 44 is at its either end formed integrally with a J-shaped resilient section 44B. The upper surface of the resilient section 44B is adapted to contact with the chassis frame. This urges the upper holder 44 toward the lower holder 43 with its restoration from resilient deformation to bring the paper dust brush 41 into its operative position. On the other hand, the upper holder 44 is swung upward against the resilient load of the resilient section 44B, whereby the paper dust brush 41 can be brought into its withdrawn position.

The transfer unit 7 is rockably moved by slide movement of the slide plate 103.

The corona charger 71 is retained by the arm 72 pivotally carried by the shaft 74 which passes through brackets vertically extending from the right and left sides of the chassis 100 at a certain distance from each other.

At the end of the arm 72 opposite to the corona charger carrying portion across its pivot axis born is the tension spring 75 with its upper end retained by an upright bracket 105 secured at its lower end to the chassis 100. The arm 72 is loaded by the tension spring 75 to allow the corona charger 71 carried by it to be brought to its transfer operative position with respect to the drum 1.

Under the pivot axis of the shaft 74 of the arm 72 mounted is a horizontally extending pin 73 which is operated by the vertical extending end face of the operating portion 103A on the slide plate 103 to rockably move the arm 72 against the tension load of the tension spring 75. With this rocking movement of the arm 72 by means of the operating portion 103A of the slide plate 103, the corona charger 71 is swung by a predetermined degree from the aforementioned transfer operating position to its withdrawing position.

Forward of the position of the arm 72 where it carries the corona charger 71 supported is a paper holder 72A in parallel with the corona charger 71. The paper holder 72A operates to press the continuous form 20 against the image transfer position of the drum 1.

The shaft 74 rockably carrying the arm 72 also has a roller arm 76 rockably mounted thereon, through not shown in detail.

The roller arm 76 has a paper holder 76A rotatably mounted on the forward end thereof, with its near end formed with an operating portion 76B.

The roller arm 76 is loaded by a torsion spring 77 wound around the shaft 74 so that the paper holder 76A is pivotally urged toward the corona charger 71, whereby the both (paper holder 76A and the corona charger 71) are held in predetermined relative positions. The swing torque of the roller arm 76 exerted by the torsion spring 77 is set to be smaller than the swinging torque of the arm 72 by means of the tension spring 75.

That is, the roller arm 76 and the arm 72 becomes an integral unit in their certain positional relationship and is rockably movable about the shaft 88 as such an integral unit. Therefore, when the arm 72 is swung by the operating portion 103A of the slide plate 103, the roller arm 76 kept integral therewith is rockably moved keeping its position relative to the arm 72. When the operating portion 76B at the rear end of the roller arm 76 is pushed downward in FIG. 23, however, the roller arm 76 alone is swung overcoming the loading force of the torsion spring 77, so that the paper holder 76A is moved upward apart from the corona charger 71 (their relative positions are changed).

With the corona charger 71 being in its transfer operative position, the roller arm 76 is in a relative position where its paper holder 76A is located closer to the inlet of the continuous form 20 and to the drum 1 than the corona charger 71. At this time, the continuous form 20 is passed through a space between the paper holder 76A and the corona charger 71 so that it is brought into contact with the transfer section on the drum 1 opposite to the corona charger 71.

In a print stand-by state, the sliding movement of the slide plate 103 causes the arm 72 to pivotally move so that the corona charger 71 is moved to its withdrawn position. As a result, the continuous form 20 is less charged electrically even with a voltage kept applied. At the same time, it is pulled down by the paper holder 76A to be moved apart from the drum 1, disabling image transfer operation.

In a position corresponding to the operating portion 76B of the roller arm 76, provided is a push lever 78A fixedly mounted on the shaft 78 which is located forward of the shaft 74.

The shaft 78 is rotatably driven in association with opening and closing movements of the upper structural part 11 of the laser printer 10 by means of an interlock mechanism. Rotation of the shaft 78 allows the push lever 78A to apply a pressure to the operating portion 76B of the roller arm 76.

Upon opening of the upper structural part 11, the paper holder 76A alone is swung upward with the corona charger 71 remaining in its withdrawn position. This develops a greater distance between the drum 1 and the paper holder 76A and the corona charger 71, thereby facilitating loading the continuous form 20.

Thus, according to this embodiment, as in the foregoing embodiments, the backup roller 81B of the fixing unit 8 is withdrawn by driving the motor 10 to move the continuous form 20 apart from the heat roller 81A in the print stand-by state. At the same time, the corona charger 71 of the transfer unit 7 is moved to its withdrawn position through sliding movement of the slide plate 103, while also moving the upper paper drust brush 41 of the paper dust brush pair 40 upward to its withdrawn position.

As described above, according to the printer embodying the invention, withdrawing the continuous recording paper from the drum at the transfer unit and from the heat roller and withdrawing the paper dust brush in the print stand-by state can be accomplished by a single drive means, whereby it is possible to prevent damage and wear of the drum as well as problems associated with heat applied to the continuous recording paper, while also avoiding positional displacement upon withdrawal movement of the recording paper. This makes it possible to start printing at a correct position.

FIGS. 24 through 28 show other embodiment of the invention, wherein the transfer unit 7 includes, arms 72 arranged at a certain space from the drum 1 in parallel therewith for supporting the corona charger 71.

The arm 72 is at each end thereof rockably mounted on a shaft 74 which passes through brackets 101 and 102 appropriately spaced from each other and extending upright from the right and left sides of the chassis 100. The arm 72 at its end opposite to the corona charger mounting portion across the pivot center bears the upper end of a tension spring 75 whose lower end is retained by the bracket 105 planted at its lower end to the chassis 100.

The tension spring 75 rockably preloads the arms 72 to bring the corona charger 71 retained by it to its transfer operating position with respect to the drum 1. This rocking movement is restrained by contact of a pin 72A provided on a side of the arm 72 with the top end surface of the bracket 101. This position where rocking movement is restrained is the transfer operative position of the corona charger 71.

Below the pivot center on which the arm 72 is carried by the shaft 74 horizontally provided is a pin 73 which is adapted to be operated by the vertical end face of an operating member 103A extending upright from the slide plate 103 which is mounted on the chassis 100 for sliding movement in fore and aft directions in the laser printer 10. With this operation of the pin 73, the arm 72 is rockably moved overcoming the tension load of the tension spring 75. With this rocking movement of the arm 72 with the operating member 103A of the slide plate 103, the corona charger 71 is separated from the drum 1 to effect a certain degree of rocking movement from its transfer operative position to its withdrawn position.

On the same shaft 74 rockably carrying the arm 72 pivotally mounted is a roller arm 76 as shown in FIG. 26, the III—III section of FIG. 25(A).

The roller arm 76 rotatably carries at its leading end (closer to the continuous form inlet than the pivotal center of the shaft 74) a plurality of paper holder rollers 76A arranged in series over the entire width of the continuous form 20. The rear end of the roller arm 76 is provided with an operating portion 76B.

The roller arm 76 is preloaded by a torsion spring 77 surrounding the shaft 74 so that the paper holder rollers 76A are moved toward the corona charger 71 (in the direction indicated by the arrow in FIG. 26.) Their relative pivotal movements are restrained by contact of a stopper contact portion 76C formed adjacent the pivotal point of the shaft 74 with a stopper 72B formed by bending the corresponding portion of the arm 72. Relative position of the roller arm 76 and the arm 72 is thus determined by this restricted pivotal movement relative to each other. Here, the swing torque of the roller arm 76 due to preload of the torsion spring 77 is chosen to be smaller than the swing torque of the arm 72 by the tension spring 75.

Thus, the roller arm 76 and the arm 72 are biased by the torsion spring 77 and bring the paper holder rollers 76A and the corona charger 71 into their predetermined positions as a single unit. In this single unit state, they are pivotally movable about the shaft 74. When the arm 72 is rockably moved by the operating member 103A of the slide plate 103, therefore, the roller arm 76 also effects pivotal movement integrally with the arm 72. When the operating portion 76B at the rear end of the roller arm 76 is pushed down in the drawing, on the other hand, the roller arm 76 alone is rockably moved against the load of the torsion spring 77 so that the paper holder rollers 76A are moved upward apart from the corona charger 71 (i.e., their relative positions change accordingly).

When the corona charger 71 is in its transfer operative position, the rollers arm 76 are so positioned that its paper holder rollers 76A are located closer to the continuous from inlet than the corona charger 71 while approaching to the drum 1. At this time, the continuous form 20 is passed between the paper holder rollers 76A and the corona charger 71 and is brought to the transfer portion of the drum 1 opposite to the corona charger 71. In the print stand-by state, the corona charger 71 is moved to its withdrawn position by rocking movement of the arm 72 through slide movement of the slide plate 103. Electric charge on the continuous from 20 is thus reduced with the voltage kept applied to the corona charger 71. The form 20 is at the same time pulled down by the paper holder rollers 76A to separate it from the drum 1 to disable the image transfer operation.

Ahead of the shaft 74 as a pivot axis of the arm 72 and the roller arm 76 in the paper feed direction, located is a shaft 78 which extends at a right angle to the paper feed direction.

The shaft 78 is rotatably carried between one bracket 102 extending upright from the chassis 100 and the other bracket 104 extending upright from the side opposite to the bracket 102. The portion of the shaft 78 which corresponds to the operating member 76B of the roller arm 76 is each provided with a pressure lever 78A secured thereto.

On the outer side of the bracket 104 provided is a push-up guide 104A as shown in FIG. 28. The push-up guide 104A is provided with a push-up shaft 79 slidably extending upright therefrom. A spring 79B is interposed between a pin 79A which is passed through and secured to the push-up shaft 79 and the underplate of the push-up guide 104A. The push-up shaft 79 is loaded to be projected upward by means of the resilient restoration force of the spring 79B. All these thus constitute the push-up mechanism.

The position where the push-up shaft 79 is located corresponds to the push-up contact portion formed at the underside of the drum unit 13A. The load of the spring 79B for pushing up the push-up shaft 79 is chosen to be the force capable of pushing up the drum unit 13. Thus, with no pressure force exerted to the drum unit 13 from above (e.g. by means of the clam shell 12), the top end of the push-up shaft 79 is brought into contact with the push-up contact portion of the drum unit 13 to push it up to a floating position.

The pin 79A passed through and secured to the push-up shaft 79 is in engagement with an operating lever 78B internally extending through and secured to the shaft 78 as shown in FIG. 25(B) which is a section taken along the line B—B of FIG. 25(A). With up and down movements of the push-up shaft 79, the operating lever 78B is thus rockably moved to rotate the shaft 78. As the shaft 78 is thus rotated, the pressure lever 78A is swung to push the operating member 76B of the roller arm 76. When the clam shell 12A is now closed so that the drum unit 13A is locked in position under pressure by the clam shell 12, and the push-up shaft 73 is in its pushed-down position by means of the drum unit 13, there is a sufficient distance between the pressure lever 78A and the operating member 76B of the roller arm 76 as shown in FIG. 26.

With the configuration of the laser beam printer 10 as described above, in the print stand-by state, the backup roller 81B of the fixing roller pair 81 is withdrawn to separate the continuous from 20 from the heat roller 81A, while also withdrawing the corona charger 71 of the transfer unit 7 from its transfer operating position. The continuous form 20 is also separated from the drum 1 by means of the paper holder rollers 76A. This prevents not only the troubles associated with continuous application of heat from the heat roller 81A to the same portion of the continuous from 20, but also the troubles arising from contact of the continuous from 20 with the drum 1 even if only the drum 1 starts rotation while the continuous form 20 stands still at the start (re-start) of printing.

At times other than printing, the transfer unit 7 and the fixing unit 8 are kept in their withdrawn positions so that loading the continuous from 20 takes place in this condition.

When the clam shell 12A is released from lock to open it in loading the continuous from 20, the drum unit 13A is relieved of the downward pressure so that it is pushed up by the push-up shaft 79 to its position floating to the certain level.

With this upward sliding movement of the push-up shaft 79, the shaft 78 is rotated by means of the operating lever 78B so that the pressure lever 78A is swung to operate the operating member 76B of the roller arm 76 under pressure. As a result, the roller arm 76 is rockably moved to allow the paper holder rollers 76A to move up beyond it.

Thus, when the clam shell 12A is opened with the corona charger 71 in its withdrawn position, the drum unit 13A is brought to its floating position by means of the push-up shaft guide 79 as shown in FIG. 28. With the corona charger 71 maintained in its withdrawn position, the paper holder rollers 76A alone are swung upward (the paper holder rollers 76A take the same positions as in transfer operation with this swinging movement) so that a considerable space is made between the drum 1 and the paper holder rollers 76A and the corona charger 71 for easier loading of the continuous form 20.

As has been described above, according to this invention, the transfer charger is withdrawn and the recording paper is separated from the drum by means of the paper holder element to prevent any possible troubles. In loading recording paper, the paper holder element alone is pivotally moved to provide a space from the transfer charger, thereby ensuring easier loading of recording paper and therefore an improved operability.

What is claimed is:

1. A printer for electrophotographically forming an image on a continuous-form recording paper, comprising:

a pair of fixing rollers, at least one of said fixing rollers being withdrawable so that it can be moved from a fixing roller operative position to a fixing roller withdrawn position;

a transfer charger that is movable between a transfer charger operative position to a transfer charger withdrawn position; and drive means for executing a withdrawing and restoring operation to simultaneously withdraw said withdrawable fixing roller and said transfer charger to respective withdrawn positions, or simultaneously restore said withdrawable fixing roller and transfer charger to respective operative positions.

2. The printer of claim 1, further comprising:

means for fixedly locking said transfer charger in its withdrawn position; and means for releasing said transfer charger lock means.

3. The printer of claim 1, wherein said transfer charger is carried by a pivotally rockable arm member to allow said transfer charger to move from its operative position to its withdrawn position by a pivotal movement of said arm member, said arm member having a pressure guide that is rockably mounted on a pivotal center of said pressure guide for making a pivotal movement relative to said arm member, said pressure guide flexing a paper feed path towards a photoconductive drum that is located after said transfer charger, said arm member being adapted to be pivotally driven for making a withdrawing movement within a certain range of said pivotal movement of said pressure guide; said printer further comprising means for executing pivotal movements of said withdrawable roller and pressure guide.

4. The printer of claim 3, further comprising:

means for biasing said pressure guide to a predetermined position;

means for biasing said transfer charger to its transfer operative position;

means for fixedly locking said pressure guide in a withdrawn position; and means for releasing said pressure guide locking means.

5. A printer for electrophotographically forming an image on a continuous-form recording paper, comprising:

dust brush means provided adjacent an inlet of said continuous-form recording paper, said dust brush means being withdrawable from a position in which said dust brush means contacts said continuous-form recording paper;

fixing roller means that is withdrawable from a fixing roller operative position;

transfer means that is withdrawable from a transfer operative position; and drive means for withdrawing and restoring said withdrawable fixing roller means, transfer means and dust brush means at predetermined timings.

6. A printer for electrophotographically forming an image on a continuous-form recording paper, comprising a pivotally withdrawable transfer charger and a paper holder for holding said recording paper for said transfer charger, said transfer charger and said paper holder being pivotally swung to separate said recording paper from a photoconductive drum when said printer is in a print stand-by state, said paper holder being pivotally movable relative to said transfer charger and being provided with an operating member for effecting a pivotal movement of said paper holder independently of said transfer charger.

7. The printer of claim 6, further comprising a push-up mechanism for moving said photoconductive drum in an upward direction, and an operating member operatively associated with said push-up mechanism and said paper holder for rocking said paper holder upon a push-up movement of said photoconductive drum by said push-up mechanism.

8. The printer of claim 7, further comprising a lower structural part, and an upper structural part that is adapted to rockably open relative to said lower structural part, said upper structural part pressing said photoconductive drum towards said lower structural part so as to lock said photoconductive drum in a predetermined position upon a closing of said upper structural part, while upon an opening of said upper structural part, said upper structural part is released to allow said photoconductive drum to be pushed up a predetermined amount by said push-up mechanism.

9. An electrophotographic printer that forms an image on a recording form, comprising:

a brush that is provided adjacent an inlet of said recording form, said brush being movable from an operative position in which said brush is proximate said recording form to a withdrawn position in which said brush is moved away from said recording form;

a fixing roller that is movable from an operative position proximate said recording form to a withdrawn position away from said recording form;

a transfer charger that is movable from an operative position proximate said recording form to a withdrawn position away from said recording form; and means for driving said fixing roller, transfer charger and brush to either their respective withdrawn positions or their respective operative positions at predetermined timings.

10. The printer of claim 9, wherein said recording form comprises a continuous-form recording paper.

11. A printer for electrophotographically forming an image on a recording form, comprising:

a withdrawable transfer charger; and means for holding said recording form for said transfer charger, said transfer charger and said recording form holding means being movable to move said recording form away from a photoconductive drum when said printer is in a print stand-by state, said recording form holding means being movable relative to said transfer charger and having an operating member that effects a movement of said recording form holding means independently of said transfer charger.

12. The printer of claim 11, further comprising:

means for moving said photoconductive drum in an upward direction; and means operatively associated with said photoconductive drum moving means and said recording form holding means for rocking said recording form holding means upon a push-up movement of said photoconductive drum by said photoconductive drum moving means.

13. The printer of claim 11, wherein said recording form comprises a continuous-form recording paper.

14. The printer of claim 12, wherein said photoconductive drum moving means comprises a push-up mechanism.

15. The printer of claim 14, further comprising:

a lower structural part; and an upper structural part, said upper structural part being shiftable between a first and second position, said upper structural part pressing said photoconductive drum towards said lower structural part so as to lock said photoconductive drum in a predetermined position in said first position, while permitting said photoconductive drum moving means to push up said photoconductive drum by a predetermined amount in said second position.

16. The printer of claim 12, further comprising:

a lower structural part; and an upper structural part, said upper structural part being shiftable between a first and second position, said upper structural part pressing said photoconductive drum towards said lower structural part so as to lock said photoconductive drum in a predetermined position in said first position, while permitting said photoconductive drum moving means to push up said photoconductive drum in said second position.

17. A printer for electrophotographically forming an image on a recording form, comprising:

a fixing roller that can be moved between an operative position and a withdrawn position;

a transfer charger that is movable between an operative position and a withdrawn position; and shifting means for simultaneously shifting said fixing roller and transfer charger to respective withdrawn positions.

18. The printer of claim 17, wherein said recording form comprises a continuous-form recording paper.

19. The printer of claim 17, wherein said shifting means is further capable of simultaneously shifting said fixing roller and transfer charger to respective operative positions.

20. The printer of claim 17, further comprising:

means for selectively locking said transfer charger in a predetermined position in said withdrawn position; and means for releasing said transfer charger locking means.

* * * * *